US010504417B2

(12) United States Patent
Ng

(10) Patent No.: US 10,504,417 B2
(45) Date of Patent: Dec. 10, 2019

(54) LOW LATENCY DISPLAY SYSTEM AND METHOD

(71) Applicant: OmniVision Technologies, Inc., Santa Clara, CA (US)

(72) Inventor: Sunny Yat-san Ng, San Jose, CA (US)

(73) Assignee: OmniVision Technologies, Inc., Santa Clara, CA (US)

( * ) Notice: Subject to any disclaimer, the term of this patent is extended or adjusted under 35 U.S.C. 154(b) by 83 days.

(21) Appl. No.: 15/088,916

(22) Filed: Apr. 1, 2016

(65) Prior Publication Data

US 2017/0193895 A1 Jul. 6, 2017

Related U.S. Application Data

(60) Provisional application No. 62/273,558, filed on Dec. 31, 2015.

(51) Int. Cl.

| | |
|---|---|
| ***G09G 3/34*** | (2006.01) |
| ***G09G 3/20*** | (2006.01) |
| ***G09G 5/02*** | (2006.01) |
| ***G09G 5/393*** | (2006.01) |
| *G09G 5/399* | (2006.01) |

(52) U.S. Cl.

CPC ..... *G09G 3/2096* (2013.01); *G09G 3/2003* (2013.01); *G09G 5/022* (2013.01); *G09G 5/393* (2013.01); *G09G 3/3413* (2013.01); *G09G 5/399* (2013.01); *G09G 2310/0235* (2013.01); *G09G 2310/04* (2013.01); *G09G 2320/0261* (2013.01); *G09G 2340/0428* (2013.01); *G09G 2340/0464* (2013.01); *G09G 2360/16* (2013.01); *G09G 2360/18* (2013.01)

(58) Field of Classification Search

None

See application file for complete search history.

(56) References Cited

U.S. PATENT DOCUMENTS

| | | | | |
|---|---|---|---|---|
| 2002/0191104 | A1* | 12/2002 | Matsutani | H04N 5/2253 348/374 |
| 2009/0174810 | A1* | 7/2009 | Endo | G02B 26/0833 348/390.1 |
| 2012/0120205 | A1* | 5/2012 | Kobayashi | G09G 3/003 348/51 |
| 2012/0154343 | A1* | 6/2012 | Yu | G09G 3/3413 345/204 |

(Continued)

*Primary Examiner* — Xiao M Wu
*Assistant Examiner* — Steven Z Elbinger
(74) *Attorney, Agent, or Firm* — Larry E. Henneman, Jr.; Henneman & Associates, PLC

(57) ABSTRACT

A novel display system includes a host and a display. In a particular embodiment the host includes a data scaler and a dual frame buffer. Frames of image data are down-scaled before being transferred to the display, and is up-scaled while being loaded into the frame buffer or the display. The down-scaled frames of image data include less data than the frames of image data. In another embodiment, the process of loading the image data into the display begins before an entire frame of data is loaded into the frame buffer. Increasingly sized portions of the image data, each corresponding to a different color field, are asserted on the display and displayed one at a time. The portions of the frame that were not previously displayed are displayed along with the initial portions of a subsequent frame.

45 Claims, 27 Drawing Sheets

(56) References Cited

U.S. PATENT DOCUMENTS

| | | | | |
|---|---|---|---|---|
| 2012/0306945 | A1* | 12/2012 | Lee | G09G 3/3413 345/691 |
| 2014/0152676 | A1 | 6/2014 | Rohn et al. | |
| 2016/0253560 | A1* | 9/2016 | Tokutake | G06F 3/0412 |

* cited by examiner

Second Time Period

Third Time Period

Fourth Time Period

Fifth Time Period

Sixth Time Period

Seventh Time Period

LOW LATENCY DISPLAY SYSTEM AND METHOD

RELATED APPLICATIONS

This application claims the benefit of priority to currently pending U.S. Provisional Patent Application No. 62/273,558, filed by the same inventor on Dec. 31, 2015, which is incorporated herein by reference in its entirety.

BACKGROUND OF THE INVENTION

Field of the Invention

This invention relates generally to digital video displays, and more particularly to displays with features that improve latency.

Description of the Background Art

Liquid crystal displays typically include large arrays of individual pixels. Intensity values to be displayed by each pixel are typically represented by multi-bit data words, and each bit of the multi-bit data word is asserted on the pixel during a portion of a video frame time corresponding to the significance of the asserted bit. Each bit will cause the pixel to display either a light ("on") or dark ("off") intensity, depending on the values of the asserted bits. Over the frame time, an observer's eye integrates the light and dark intensities of the individual bits, to perceive an intermediate intensity value corresponding to the value of the multi-bit data word.

The process of loading each data bit onto each pixel takes some time. The latency of a display is defined as the amount of time between the receipt of a first portion of a frame of image data into a buffer of the display and the first assertion of data of that frame on the pixels of the display.

The increase in interactive display technology, such as computer monitors, video game consoles, and virtual reality headsets, among others, has created a need for systems with decreased latency. In such technology, video data must be altered as the user interacts with the device or with the world. For example, a head mounted display might display information over an object in the user's field of view. If the information is intended to be displayed in a fixed position with respect to the world, image data from the device must be constantly altered as the user moves his/her head or eyes with respect to the object. In known devices, visual artifacts (blurred or jerky object motion) are caused by the latency of the display device.

Efforts to improve latency in liquid crystal displays have not been fully satisfactory. While some have decreased latency in certain display devices, the delays remain significant in applications requiring immediate alteration of image data. For example, in known devices there is at least a one frame delay between receiving the image data and displaying it. What is needed, therefore, is a system and method for decreasing latency of a display to less than the frame time of the display.

SUMMARY

The present invention overcomes the problems associated with the prior art by providing a digital display and a novel method of writing data to the display. The invention facilitates a significant reduction in the latency of the display, by reducing the amount of data that is loaded into a display driver before a given frame is displayed. In one embodiment of the present invention, the size of frames of image data is reduced to generate frames of down-scaled image data, which contain many fewer data words than the original image data. The down-scaled image data can be loaded into the driver, and consequently displayed by the display, much quicker than the original image data.

In another embodiment, portions of frames of image data are displayed before the entire frame of image data is loaded into the display driver. For example, less than a full red color field of an initial frame is displayed after only a portion of the full initial frame of data is received. Then, less than a full green color field of the initial frame is displayed before the full initial frame of data is received. Finally, a full blue color field is displayed. The remaining two-thirds of red data and one-third of green data of the initial frame is displayed with the next frame of data, portions of which are also displayed before the entire next frame is loaded into the display driver.

An example display system includes a display, including a plurality of individual pixels, and a display driver. The display driver is coupled to receive sequential frames of image data and to assert at least a portion of the image data on the pixels of the display. The display driver also asserts at least some data corresponding to each frame of the image data on the pixels of the display within a predetermined amount of time after receiving a first portion of each frame of the image data. The predetermined amount of time is less than an amount of time required for the display driver to receive a full frame of the image data.

In an example embodiment the display system includes an image data scaler, which is electrically coupled to receive the frames of image data and operative to reduce the size of the image data. Each frame includes a particular amount of data, and in reducing the size of the image data, the image data scaler generates down-scaled frames of image data, which include less than the particular amount of data. The image data scaler also provides the down scaled frames of image data to the display driver. The display driver is electrically coupled to receive the down-scaled frames of image data from the image data scalar, and is operative to increase the size of the down-scaled frames of image data. In increasing the size of the down-scaled frames of image data, the display driver generates up-scaled frames of image data and also asserts at least some data from each of the up-scaled frames of image data on pixels of the display before receiving an amount of data corresponding to the particular amount of data.

In a particular embodiment, the down-scaled image data includes no more than 75% of the amount of image data in a frame of the originally formatted image data. In another more particular embodiment, the down-scaled image data includes no more than 50% of the amount of image data in a frame of the originally formatted image data.

In another more particular embodiment, the image data scaler is operative to generate the down-scaled data by omitting data values associated with particular pixels of the display from the originally formatted data. In yet a more particular embodiment, the image data scaler is operative to generate the down-scaled data by omitting data values associated with predefined rows of pixels of the display from the originally formatted data.

Optionally, the display system includes a controller operative to dynamically transition the image data scaler between an on-state and an off-state. For example, one embodiment includes a sensor. The controller, responsive to data from the sensor, transitions the image data scaler between the on-state and the off-state. In a more particular embodiment, the sensor is an image sensor. In another more particular embodiment, the sensor is a motion sensor. In yet another more particular embodiment, the sensor is an orientation sensor.

In another example embodiment, the display system includes an image data buffer electrically coupled to receive the sequential frames of image data. The image data buffer provides the sequential frames of image data to the display. The display driver is operative to assert a portion of a first frame of image data on a first set of the pixels of the display, and assert a portion of a second frame of image data on a second set of pixels. The portion of the second frame is asserted on the second set of pixels while the portion of the first frame is being asserted on the first set of pixels. The display is illuminated with light of a first color while the portion of the first frame and the portion of the second frame are being simultaneously asserted on the pixels of the display. The display is illuminated before the entire second frame is received in the image data buffer. In a particular embodiment, the portion of the first frame is larger than the portion of the second frame.

In another particular embodiment, the display driver asserts a second portion of the first frame on a third set of pixels, and also asserts a second portion of the second frame on a fourth set of pixels. The second portion of the second frame is asserted on the fourth set of pixels while the second portion of the first frame is being asserted on the third set of pixels. The display is illuminated with light of a second color while the second portion of the first frame and the second portion of the second frame are being simultaneously asserted on the pixels. In a more particular embodiment, the second portion of the first frame is smaller than the second portion of the second frame.

In yet another particular embodiment, the display driver asserts a third portion of the second frame on all of the pixels. The display is illuminated with light of a third color while the third portion of the second frame is asserted on all of the pixels.

In another particular embodiment, one of the first set of pixels and the second set of pixels includes one-third of the pixels of the display. The other of the first set of pixels and the second set of pixels includes two-thirds of the pixels of the display. In yet another particular embodiment, one of the first set of pixels and the second set of pixels includes a middle one-third of the pixels of the display. In another particular embodiment, one of the first set of pixels and the second set of pixels includes one-fourth of the pixels of the display, and the other of the first set of pixels and the second set of pixels includes three-fourths of the pixels of the display.

A method for displaying digital data is also described. The method includes receiving sequential frames of image data, and asserting at least some data corresponding to each frame of the image data on pixels of a display within a predetermined amount of time after receiving a first portion of each frame of the image data. The predetermined amount of time is less than an amount of time required to receive each full frame.

An example method includes receiving frames of originally formatted image data, reducing the size of the image data to generate frames of down-scaled image data, providing the frames of down-scaled image data to a display, increasing the size of the frames of down-scaled image data to generate frames of up-scaled image data, and asserting at least some data from each of the frames of up-scaled image data on pixels of the display. The originally formatted frames of image data each include a particular amount of data. The down-scaled frames of image data each include less than the particular amount of data. The data is asserted on the pixels of the display before an amount of data corresponding to the particular amount of data is received.

A particular method includes asserting at least some data of each frame of the up-scaled image data on the pixels of the display within a certain amount of time after receiving a first portion of each frame of the down-scaled image data. The certain amount of time is less than an amount of time required for the display to receive a frame of the originally formatted data.

In another particular method, the step of reducing the size of the image data to generate frames of down-scaled image data includes generating frames of down-scaled image data each including no more than 75% of the amount of image data in a frame of the originally formatted image data. In a more particular embodiment, the step of reducing the size of the image data to generate frames of down-scaled image data includes generating frames of down-scaled image data including no more than 50% of the amount of image data in a frame of the originally formatted image data.

In yet another particular method, the step of reducing the size of the image data to generate frames of down-scaled image data includes omitting data values associated with particular pixels of the display from the originally formatted data. In another particular method, the step of reducing the size of the image data to generate frames of down-scaled image data includes omitting data values associated with predefined rows of pixels of the display from the originally formatted data.

In yet another particular method, the step of reducing the size of the image data includes reducing the size of the image data when a predefined condition is met and not reducing the size of the image data when the predefined condition is not met. Particularly, the step of reducing the size of the image data includes receiving data from a sensor and determining whether the condition is met based at least in part on the data from the sensor. In an even more particular method, the step of receiving data from a sensor includes receiving data from an image sensor. In another more particular method, the step of receiving data from a sensor includes receiving data from a motion sensor. In yet another more particular method, the step of receiving data from a sensor includes receiving data from an orientation sensor.

Another example method includes the steps of asserting a portion of a first frame of image data on a first set of the pixels of the display and asserting a portion of a second frame of image data on a second set of pixels. The portion of the second frame is asserted on the second set of pixels while the portion of the first frame is being asserted on the first set of pixels. The method also includes illuminating the display with light of a first color while the portion of the first frame and the portion of the second frame are being simultaneously asserted on the pixels. The display is illuminated before the entire second frame is received in the image data buffer. In a particular method, the portion of the first frame is larger than the portion of the second frame.

Another particular method includes the steps of asserting a second portion of the first frame on a third set of pixels and asserting a second portion of the second frame on a fourth set of pixels. The second portion of the second frame is asserted on the fourth set of pixels while the second portion of the first frame is being asserted on the third set of pixels. The method also includes illuminating the display with light of a second color while the second portion of the first frame and the second portion of the second frame are being simultaneously asserted on the pixels of the display. In a more particular method the second portion of the first frame is smaller than the second portion of the second frame.

Yet another particular method includes the steps of asserting a third portion of the first frame on a fifth set of pixels and asserting a third portion of the second frame on a sixth set of pixels. The third portion of the second frame is asserted while the third portion of the first frame is being asserted on the fifth set of pixels. The method also includes illuminating the display with light of a third color while the third portion of the first frame and the third portion of the second frame are being simultaneously asserted on the pixels of the display.

In an even more particular method, the third portion of the first frame includes 0% of the first frame and the third portion of the second frame includes 100% of the second frame. Additionally, the fifth set of pixels includes none of the pixels of the display and the sixth set of pixels includes all of the pixels of the display.

In another particular method, one of the first set of pixels and the second set of pixels includes one-third of the pixels of the display. The other of the first set of pixels and the second set of pixels includes two-thirds of the pixels. In yet another particular method, one of the first set of pixels and the second set of pixels includes a middle one-third of the pixels. In another particular method, one of the first set of pixels and the second set of pixels includes one-fourth of the pixels, and the other of the first set of pixels and the second set of pixels includes three-fourths of the pixels.

Another example method for displaying digital video data is also described. The method includes loading sequential frames of video data into a data buffer. Each frame of video data includes a plurality of color fields. The method also includes asserting a first portion of a first color field of a first frame of the video data onto a display and illuminating the display with a first colored light corresponding to the first color field. The first portion of the first color field is asserted after the first portion of the first color field is loaded into the data buffer and before an entirety of the first frame is loaded. The method also includes asserting a first portion of a second color field onto the display and illuminating the display with a second colored light corresponding to the second color field. The first portion of the second color field is asserted after the first portion of the second color field is loaded into the data buffer and before the entirety of the first frame is loaded. The method further includes asserting a first portion of a third color field onto the display and illuminating the display with a third colored light, corresponding to the third color field. The first portion of the third color field is asserted after the first portion of the third color field is loaded into the data buffer.

Additionally, the method includes asserting a first portion of the first color field of a second frame of video data and a remaining portion of the first color field of the first frame onto the display and illuminating the display with the first colored light. The first portion and the remaining portion are asserted after the first portion of the first color field of the second frame is loaded into the data buffer and before an entirety of the second frame is loaded. The method further includes asserted a first portion of the second color field of the second frame and a remaining portion of the second color field of the first frame onto the display and illuminating the display with the second colored light. The first portion and the remaining portion are asserted after the first portion of the second color field of the second frame of video data is loaded into the data buffer and before the entirety of the second frame is loaded. Additionally, the method includes asserting a first portion of a third color field of the second frame and any remaining portion of the third color field of the first frame into the display and illuminating the display with the third colored light. The first portion and the remaining portion are asserted after the first portion of the third color field of the second frame is loaded into the data buffer.

BRIEF DESCRIPTION OF THE DRAWINGS

The present invention is described with reference to the following drawings, wherein like reference numbers denote substantially similar elements.

DETAILED DESCRIPTION

The present invention overcomes problems associated with the prior art, by providing a system and method for decreasing display latency that includes manipulating image data and the way it is written to the display. In the following description, numerous specific details are set forth (e.g., the specific order in which portions of data are written, the structure of the data buffer, etc.) in order to provide a thorough understanding of the invention. Those skilled in the art will recognize, however, that the invention may be practiced apart from these specific details. In other instances, details of well-known digital image display practices (e.g., planarization, routine optimization, etc.) and components have been omitted, so as not to unnecessarily obscure the present invention.

Figure 1:
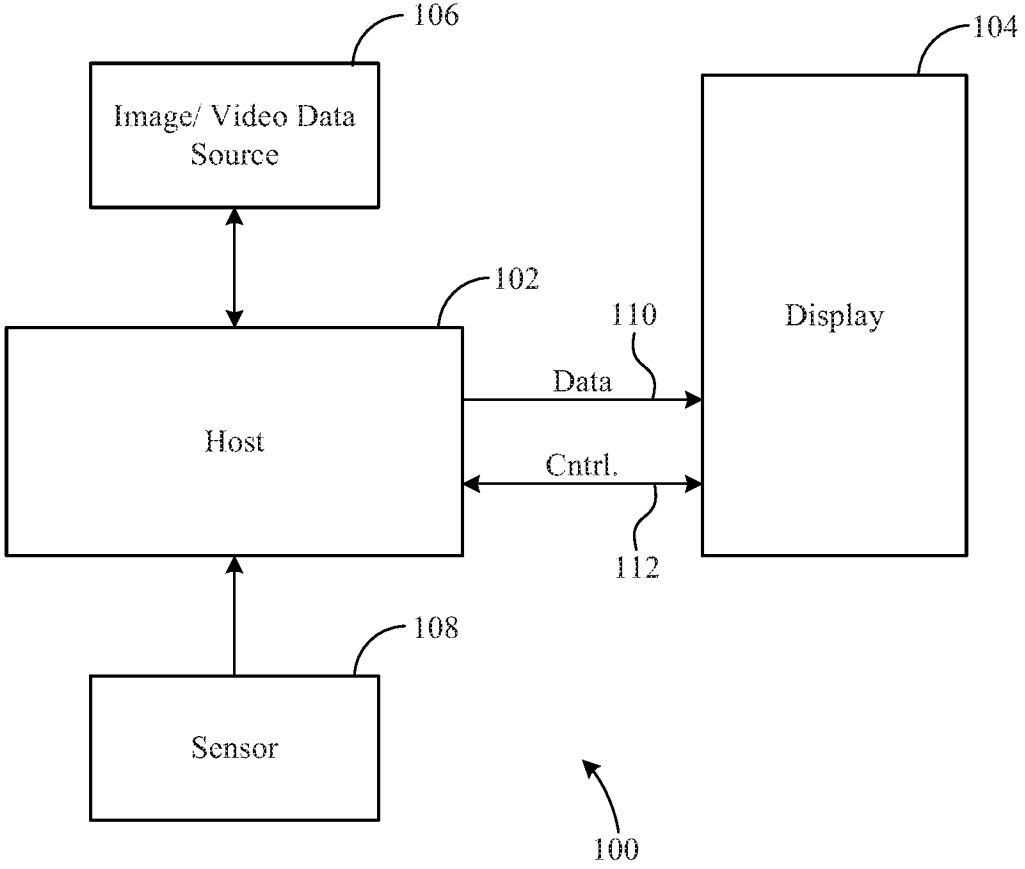
FIG. 1 is a block diagram showing an example display system.

FIG. 1 shows a display system 100 to include a host 102, a display 104, an image/video data source 106 and a sensor 108. Host 102 receives image data from data source 106 (e.g., a static memory source or a video input) and sensor 108 (e.g., an image sensor or a motion/orientation sensor). Host 102 processes the image data and writes it to display 104 via a data bus 110. Additionally, host 102 can alter video data written to display 104 based on data received from sensor 108. For example, if a displayed object needs to move based on data from sensor 108, host 102 alters the video data corresponding to the displayed object based on the data received from sensor 108. Control signals are communicated between host 102 and display 104 via a control bus 112.

In alternate embodiments, host 102 can be any of a number of various devices. For example, host 102 can be a cell phone, a head mounted display, or any other similar device. Additionally, host 102 can have display 104, data source 106, and sensor 108 embodied therein. Consequently, host 102 can include any number of devices (e.g. cameras, microphones, motion/orientation sensors, etc.), whether or not they are explicitly stated. Additionally, host 102 can serve any number of functions concurrently with the display functions described in this disclosure.

In addition, system 100 can include any combination of various devices. For example, in alternate embodiments, system 100 can include a cell phone (host 102), with data source 106 embodied therein, and a head mounted display with display 104 and sensor 108 embodied therein. In such embodiments control bus 112 can be replaced with any applicable datalink, including, but not limited to, a short range wireless (e.g., Bluetooth®) connection, a wired connection (e.g., a universal serial bus (USB)), and so on.

Figure 2:
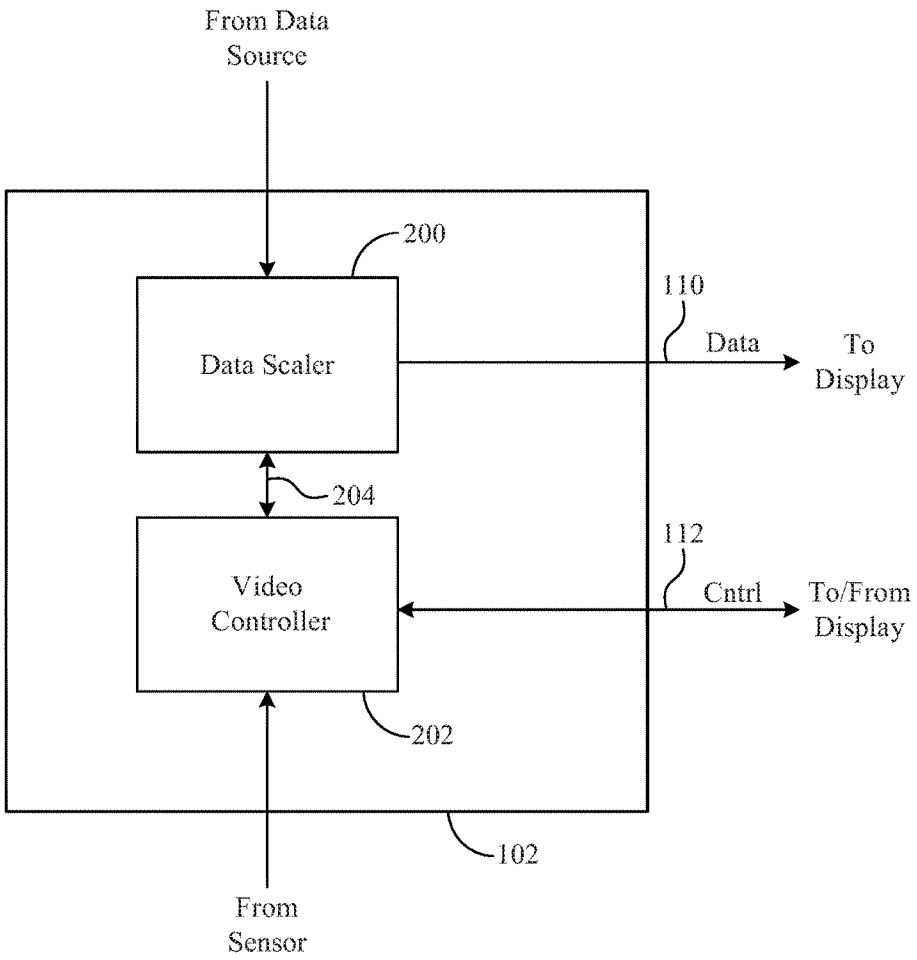
FIG. 2 is a block diagram showing an embodiment of the host of FIG. 1 in greater detail.

FIG. 2 shows some relevant functional components of host 102, including a data scaler 200, and a video controller 202. Data scaler down-scales the image data from data source 106. For example, in this particular embodiment, data scaler 200 deletes data words corresponding to a predefined portion of the pixels from the received image data. More particularly, data scaler 200 deletes the pixels corresponding to every other row or column of pixels. Data scaler 200 sends the down-scaled image data, via data bus 110, to display 104, where it will be up-scaled and displayed.

Video controller 202 receives data from sensor 108 and uses that data to control the function of data scaler 200, via a control bus 204. For example, as a user moves his/her head (or eye direction) relative to his/her surroundings, video controller 202 sends control signals to data scaler 200 to initiate the down-scaling of image data in order to improve display latency. On the other hand, when a user's head or eye direction remains fixed relative to his/her surroundings, video controller 202 sends control signals to data scaler 200 to suspend the down-scaling of image data in order to improve image resolution. Additionally, video controller 204 sends control signals to display 104 via a control bus 112. Control signals sent to display 104 include signals to coordinate video data transfer, and a signal to indicate the state of data scaler 200.

Figure 3:
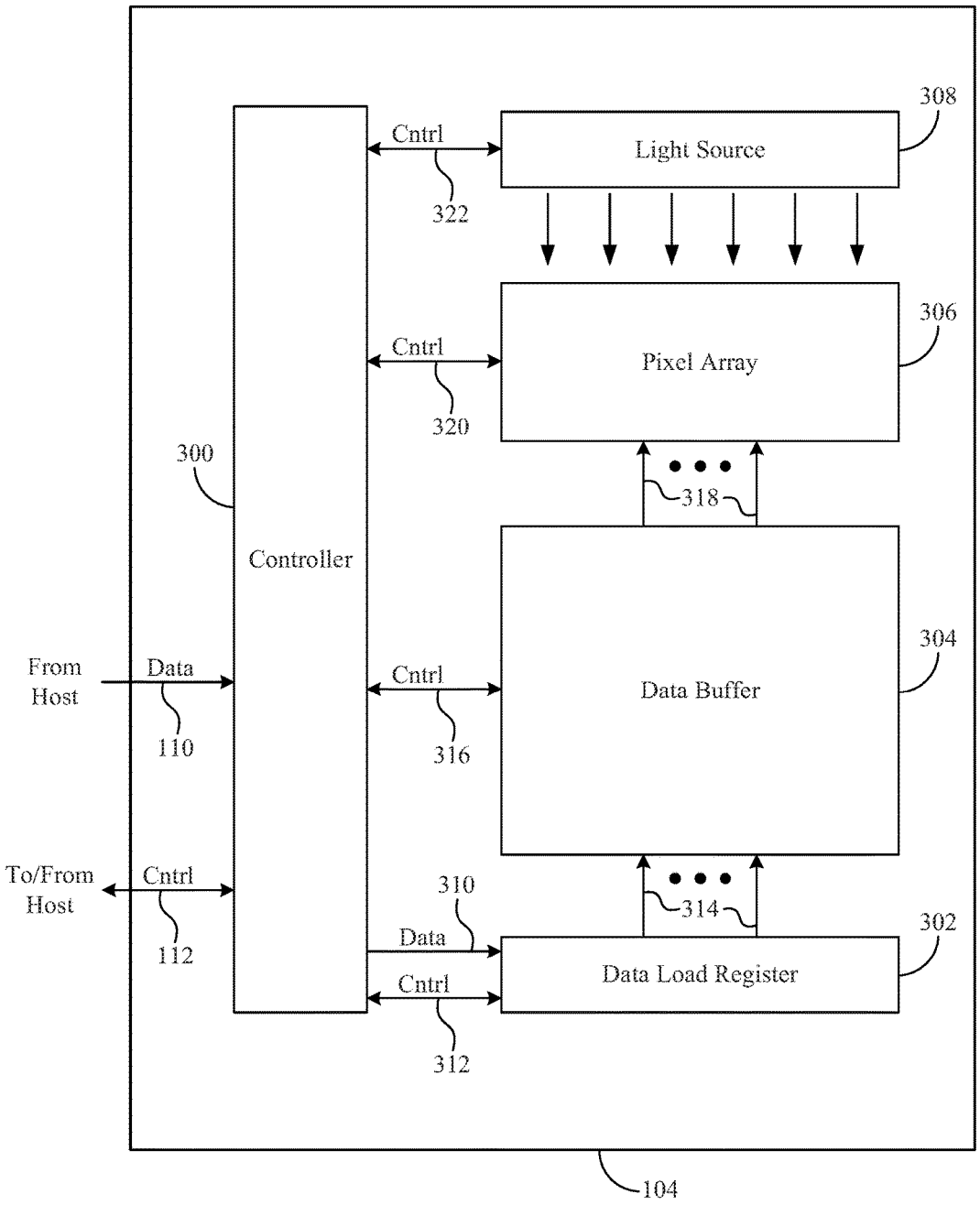
FIG. 3 is a block diagram showing the display of FIG. 1 in greater detail.

FIG. 3 shows the functional components of display 104, including a controller 300, a data load register 302, a data buffer 304, a pixel array 306, and a light source 308. Controller 300 receives image data from host 102, via a data bus 110, and sends image data and control instructions to data load register 302, via a data bus 310 and a control bus 312, respectively. Controller 300 planarizes the image data and loads it into data load register 302 in rows, by asserting control signals control bus 312.

Controller 300 also coordinates the transfer of data from data load register 302 into data buffer 304, via a data bus 314. When a full row of data is loaded into data load register 302, controller 300 asserts control signals (e.g., a row output signal) on control bus 312 and control signals (e.g., a row address and a row enable signal) on control bus 316. These control signals cause a row of data to be asserted by data load register 302 onto data bus 314 and also cause data buffer 304 to latch the asserted row of data into data buffer 304.

When data scaler 200 is functioning, each row of down-scaled video data is latched into data buffer 304 twice, resulting in up-scaled data being written to data buffer 304. For example, if the down-scaled video data includes only the odd rows of video data, then each odd row of video data will be written into its appropriate position in data buffer 304 and also into an adjacent position for an even numbered row of video data. In other words, each odd numbered row of video data will be substituted for an adjacent even numbered row of video data. Controller 300 generates the up-scaled frame of video data by duplicating the rows of data in the down-scaled image data.

By latching each row of data into data buffer 304 twice, the amount of time required to load an entire frame of data is reduced by approximately one-half. Because controller 300 can begin asserting the data in data buffer 304 on pixel array 306 as soon as the frame of up-scaled video data is latched into data buffer 304, the latency period is half of the full latency period, and a half-frame time decrease in latency is sufficient to prevent visual artifacts in the displayed images.

Data buffer 304 contains enough storage space to hold two frames of image data. This space is partitioned into two halves, which are alternately written to and read from (double buffer scheme). After a frame of image data is written to data buffer 304, that data is written to pixel array 306, via a data bus 318, while a subsequent frame is being written to data buffer 304, via data bus 314. Once the first frame is displayed, the subsequent frame of data is then written to pixel array 306, via data bus 318, while yet another frame is being written to data buffer 304. This process is repeated for as long as image data is received from host 102.

Based on the image data asserted from data buffer 304, pixel array 306 modulates and reflects light from light source 308 to a display screen (not shown), through optics (not shown), or directly into a user's eye. Light source 308 is an RGB light source operative to sequentially emit red, green or blue light onto pixel array 306, in order to create colored images. Light source 308 can include, for example, light emitting diodes, lasers, or any other suitable colored light sources.

Controller 300 provides control signals to light source 308, via a control bus 322, in order to coordinate the function of light source 308 and pixel array 306. Colored images are generated by displaying separate images in three different colors in quick succession. The human eye blends the three colors, and the perceived color of any given pixel is a function of the intensity of that pixel in each of the three colors. Controller 300 coordinates the flashing on of each colored light of light source 308 with the assertion of corresponding data onto pixel array 306.

Figure 4:
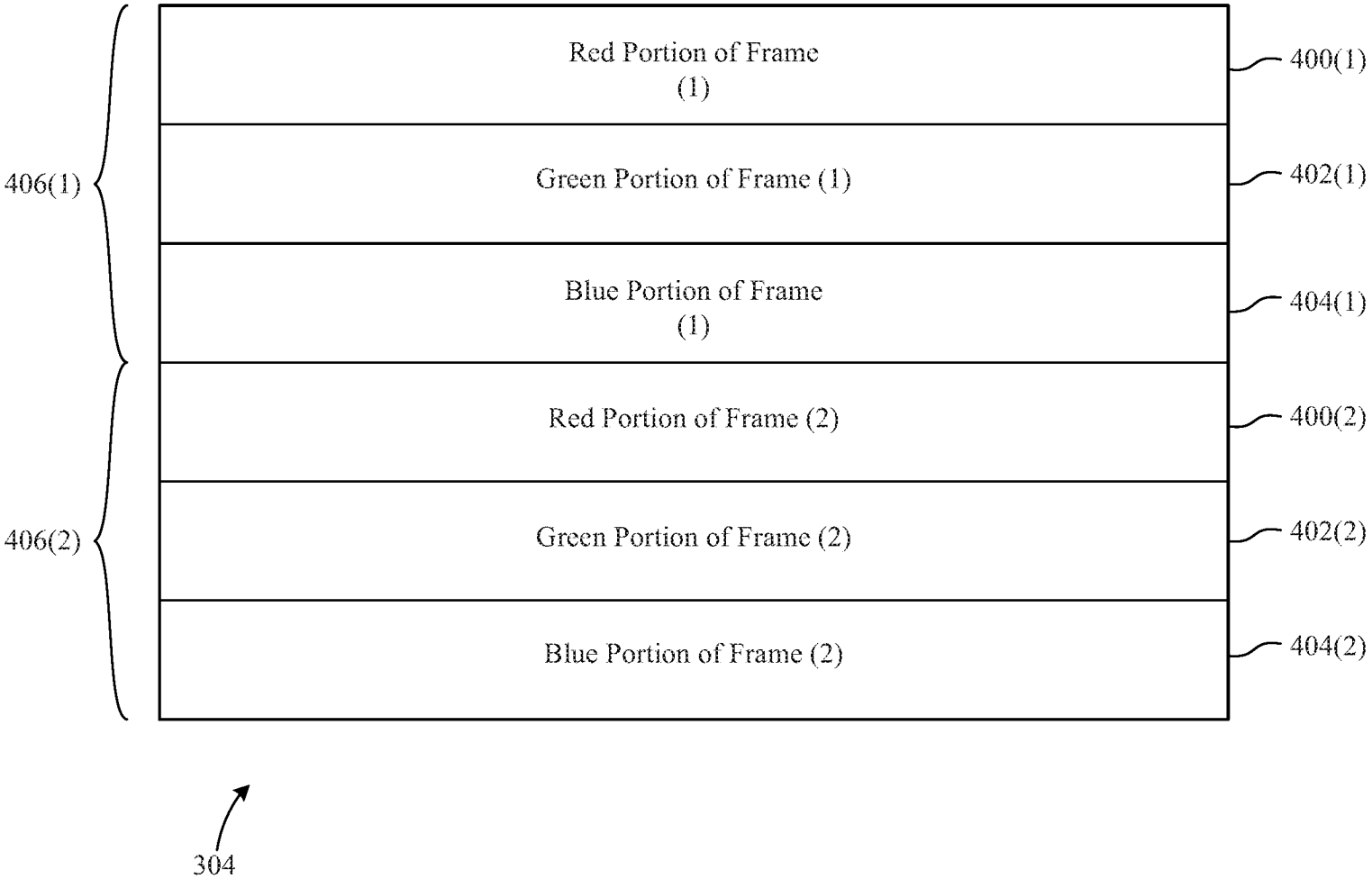
FIG. 4 is a block diagram showing the data buffer of FIG. 3 in greater detail.

FIG. 4 is a diagram illustrating the partitioning of image data in data buffer 304. In this example, data buffer 304 is partitioned into six separate portions: a first red portion 400(1), a second red portion 400(2), a first green portion 402(1), a second green portion 402(2), a first blue portion 404(1), and a second blue portion 404(2). Portions 400(1), 402(1), and 404(1) together correspond to a first half 406(1) of data buffer 304, which holds one frame of image data. Portions 400(2), 402(2), and 404(2) together correspond to a second half 406(2) of data buffer 304, which also holds another frame of image data. The portions of halves 406(1) and 406(2) are labeled with "Frame 1" and "Frame 2" for illustrative purposes only. An initial frame of image data can be written to either of halves 406(1) or 406(2). The labels are intended to illustrate that two consecutive frames will each be placed into one of halves 406(1) and 406(2), but not to suggest that either of the frames should be written to one or the other halves, specifically.

Red, green and blue image data of a particular frame is written to portions 400(1), 402(1), and 404(1), or to portions 400(1), 402(2), and 404(2). Typically, image data is received in 24-bit data words, each corresponding to a particular pixel. Every 24-bit data word is separated into 8 red bits, 8 green bits, and 8 blue bits, which are written to portions 400(1) or 400(2), 402(1) or 402(2), and 404(1) or 404(2), respectively. When data scaler 200 is functioning, some incoming data bits will be written more than once. Which data bits are duplicated depends on which data bits were originally omitted in down-scaling the image data. For example, if the originally formatted data was down-scaled by omitting data corresponding to every other row of pixels, each row of the down-scaled data would be duplicated as it is written into image data buffer 304. This method allows down-scaled data to be written to image data buffer 304 in half the time as compared to the originally formatted data. Each frame of this new, up-scaled data fills one of halves 406(1) or 406(2).

The data stored in each portion of buffer 304 corresponds to a single color field, associated with one of the three colors that make up the frame. Because the three color fields that make up a single frame are displayed one at a time, data is written to pixel array 306 from only one of the portions at a time. Data is written from one of halves 406(1) or 406(2), while data is written to the other of halves 406(1) or 406(2). By writing frames to alternating halves of data buffer 304, unnecessary delays are avoided, and latency is minimized.

Figure 5:
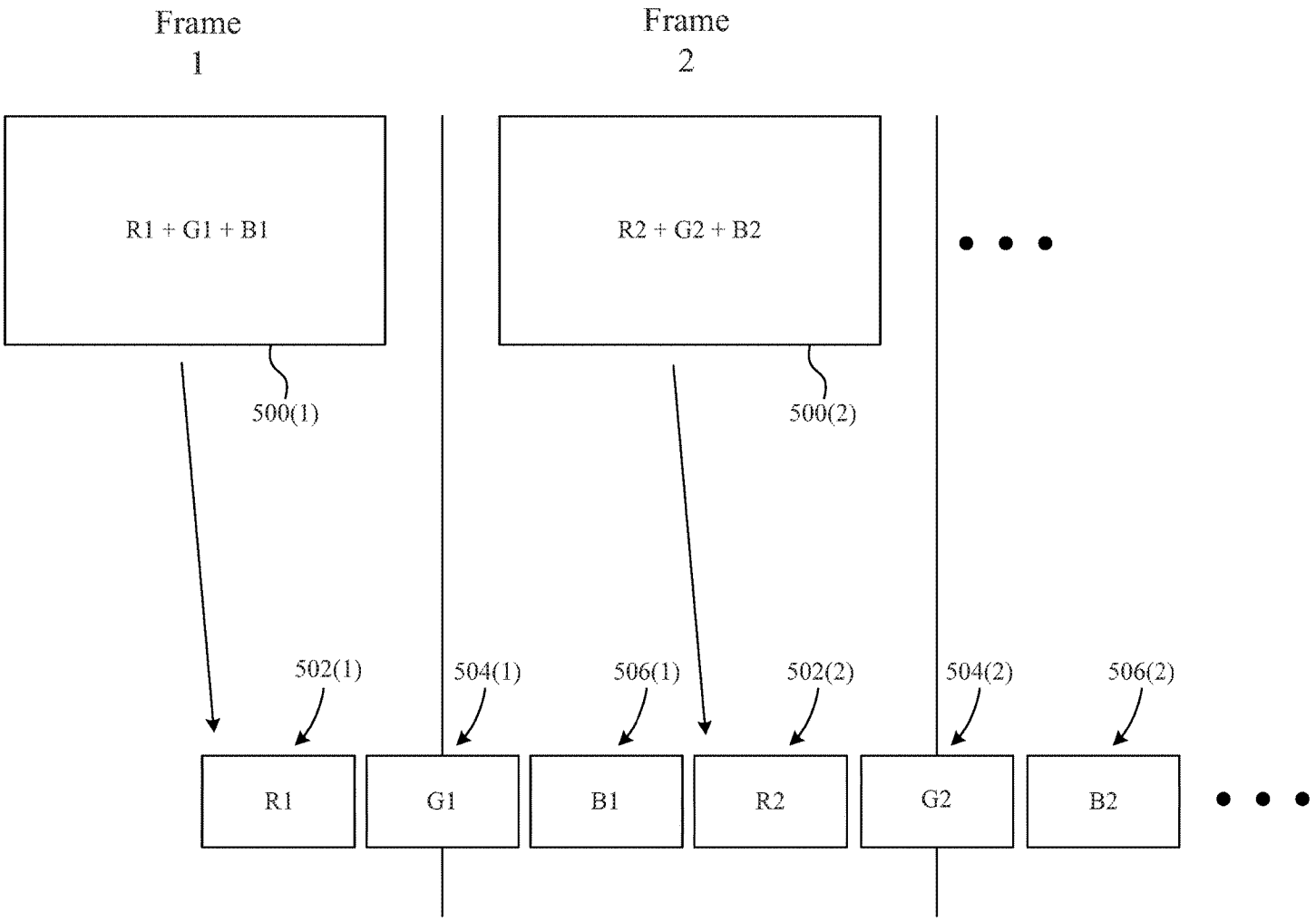
FIG. 5 is a diagram illustrating the improved latency of the system of FIG. 1.

FIG. 5 is a diagram illustrating the improved latency provided by the example embodiment of the present invention. The diagram is separated into a first frame 500(1) and a second frame 500(2), which both include red, green, and blue data. Because only half of the data is used, it only takes half of frame 1 to load first frame 500(1) begin displaying a red output field 502(1). A green output field 504(1) and a blue output field 506(1) are displayed immediately following output field 502(1). By the time output field 506 (1) is displayed, second frame 500(2) will have been loaded, and a red output field 502(2) can displayed. A green output field 504(2) and a blue output field 506(2) are displayed immediately following output field 502(2). This process continues with new frames until there is no more image data left to display. There is no delay between consecutive frames, because of the utilization of multiple data buffers.

Figure 6:
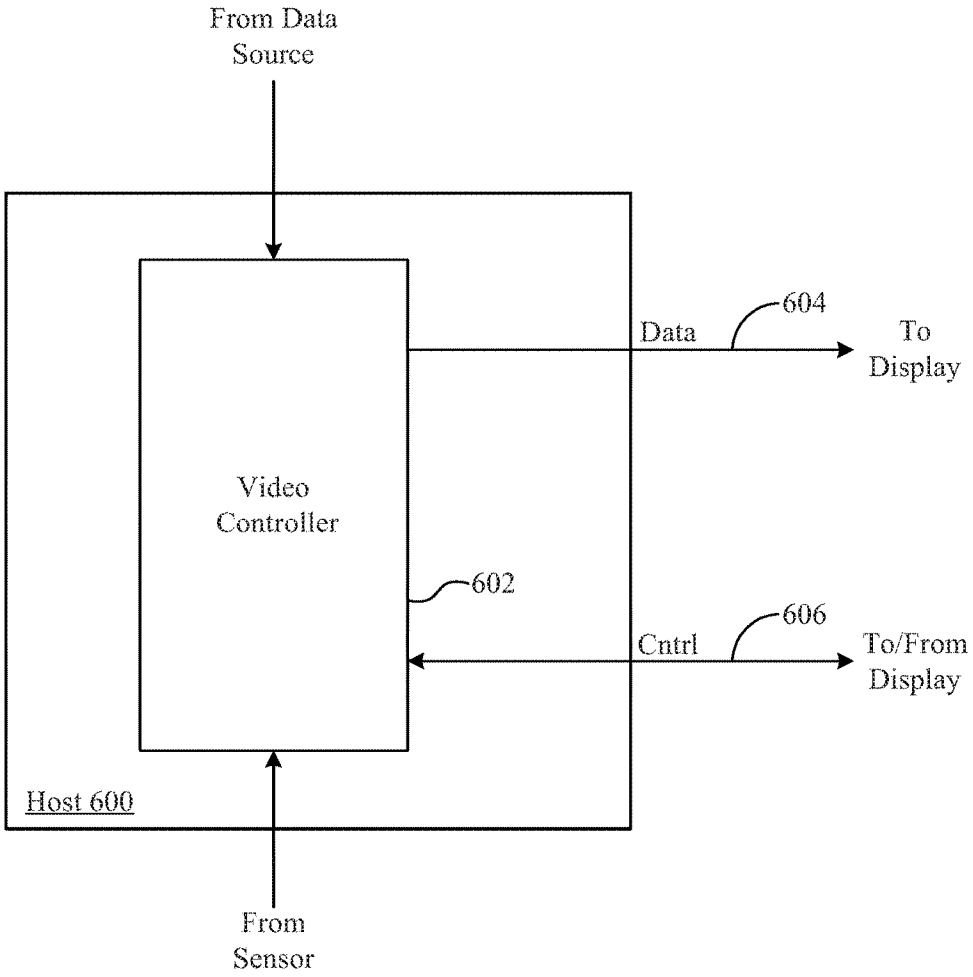
FIG. 6 is a block diagram showing an alternate host for use in the system of FIG. 1.

FIG. 6 shows an alternate host 600, including a video controller 602. Video controller 602 receives image data from a data source (not shown) and sends that image data to a display 700 (FIG. 7), via a data bus 604. Video controller 602 also receives data from a sensor (not shown) and provides control instructions, based at least in part on the data from the sensor, to display 700, via a control bus 606. For example, video controller 602 can retrieve certain image data from the data source depending on input from the sensor. In this example, video controller 602 can determine, from the sensor input, a proper perspective of a digital object to be displayed, and then, based on that perspective, retrieve image data from the data source corresponding to that perspective. Alternatively, input from the sensor can be provided directly to the data source, which can use the sensor input to determine what image data to provide to video controller 602.

Figure 7:
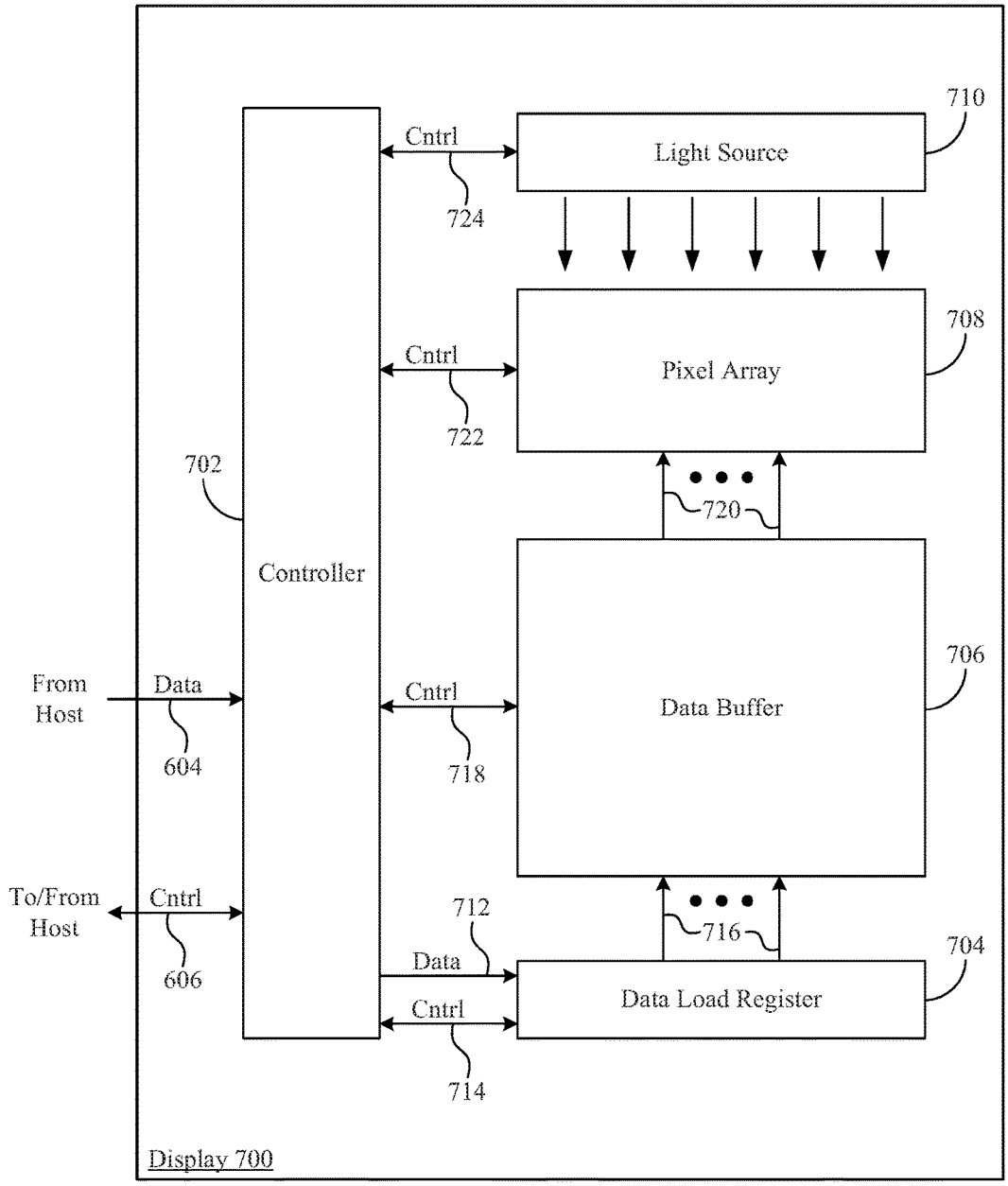
FIG. 7 is a block diagram showing an alternate display for use in the system of FIG. 1.

FIG. 7 is a block diagram of an alternate display 700, including a controller 702, a data load register 704, a data buffer 706, a pixel array 708, and a light source 710. Controller 702 receives image data from host 600 via data bus 604. Controller 702 sends image data and control signals to data load register 704 via a data bus 712 and a control bus 714, respectively. The image data is loaded into data load register 704 and arranged in rows, based on control signals from controller 702. Based on control signals from host 600, via control bus 112, controller 702 coordinates the transfer of rows of data from data load register 704 and into data buffer 706, via a data bus 716. When a full row of data is loaded into data load register 704, controller 702 asserts control signals (e.g., row output signals) onto control bus 714, and asserts control signals (e.g., a row address and a row enable signal) onto control bus 718, causing data buffer 706 to latch the row of data being asserted on data bus 716 by data load register 704.

Data buffer 706 contains enough storage space to hold two frames of image data. This space is partitioned into two halves and is used as a dual buffer. However, controller 702 can transfer data into one portion of a particular half of data buffer 706, while transferring data out of another portion of the same half of data buffer 706. After controller 702 writes a first portion of an initial frame of image data into data buffer 706, controller 702 asserts control signals (e.g., a row address and a row output signal) on control bus 718 and control signals (e.g., a row address and a row enable signal) on control bus 722, to transfer that data to pixel array 708 via a data bus 720, while the remaining portion of the initial frame continues to be transferred into data buffer 706 via data bus 716.

Only a portion of the initial frame is displayed in some of the color fields, and as more and more of the initial frame is written to data buffer 706, the portion of the initial frame data displayed in each color field increases. While the third color field of the first frame is displayed, a first portion of a subsequent frame is written to data buffer 706. The first portion of the subsequent frame is then displayed along with the previously un-displayed portion of the first color field of the initial frame. As more and more of the subsequent frame is written to data buffer 706, the portion of the initial frame displayed in each color field decreases and the portion of the subsequent frame displayed increases. This process is repeated for as long as image data is received from host 600.

Because the time between frames is small (a display working at 60 frames-per-second must display a frame every $60^{th}$ of a second), the human eye cannot detect that two portions of separate images are being displayed at once. The frames blend together smoothly. Optionally, the initial portion of image data that is displayed can consist of the middle of the frame. Because the eye is generally focused near the middle of the screen, this alternative further increases the perceived smoothness of the video and reduces the perception of any field tearing. This method will be explained in more detail as part of the description of FIG. 9B.

As briefly described above, controller 702 also coordinates the transfer of data from data buffer 706 to pixel array 708. For example, controller 702 asserts control signals on control bus 718, to cause data buffer 706 to assert a row of image data onto data bus 720. Controller 702 also asserts control signals onto control bus 722, causing pixel array 708 to latch the row of image data being asserted on data bus 720 by data buffer 706. In general, controller 702 asserts row addresses, row enable signals, and any other necessary control signals onto control buses 718 and 722 to cause the image data to be asserted on the appropriate pixels of pixel array 708 in the order and sequences described herein.

Based on the image data received from data buffer 706, pixel array 708 modulates and reflects light from light source 710 to a display screen (not shown), through optics (not shown), or directly into a user's eye. Light source 710 is an RGB light source operative to selectively emit red, green and blue light onto pixel array 708, in order to create a series of colored images.

Controller 702 provides control signals to light source 710, via a control bus 724, in order to coordinate the function of light source 710 and pixel array 708. Colored images are generated by displaying separate images in three different colors in quick succession. The human eye blends the three colors, and the perceived color of any given pixel is a function of the intensity of that pixel in each of the three colors. Controller 702 coordinates the emission of each colored light of light source 710 with the assertion of corresponding data on pixel array 708.

FIGS. 8A-8G show two sequential frames of data being written to and read from data buffer 706. Each figure shows a separate time period, and the time difference between each period is equal to the time required for a third of a frame of image data to be written to data buffer 706. Data buffer 706 is partitioned into a first red portion, a first green portion, a first blue portion, a second red portion, a second green portion, and a second blue portion. Together, the first red portion, the first green portion, and the first blue portion store a complete frame of video data. Similarly, the second red portion, the second green portion, and the second blue portion store another complete frame of video data. Each portion is additionally divided into thirds (labeled "$1^{st}$ Third of Red Portion", "$2^{nd}$ Third of Green Portion", etc.) to facilitate clear explanation of the display driving schemes described herein.

Figure 8A:
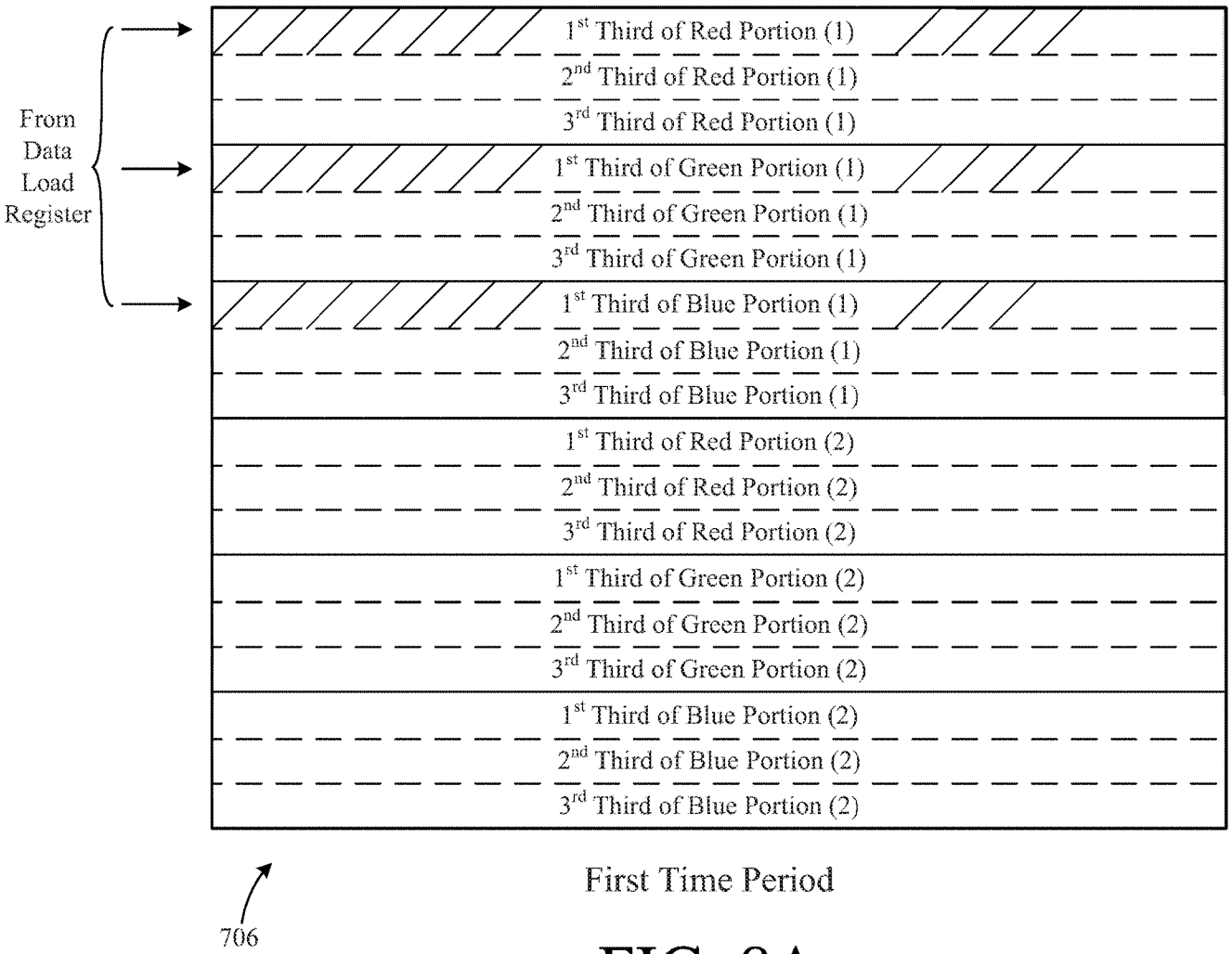
FIGS. 8A-8G are diagrams illustrating an example method for writing data to and from the data buffer of FIG. 7.

FIG. 8A shows RGB data being written to data buffer 706 during a first time period. As previously explained, the received video data includes multiple bits of data associated with each of the three colors: red, green, and blue. One-third of the data of a first frame (represented by slashes) is being written to the first third of each of the associated first colored portions: red, green, and blue. Because FIG. 8A represents the writing of an initial frame of image data, nothing is read from data buffer 706 during the first time period.

Figure 8B:
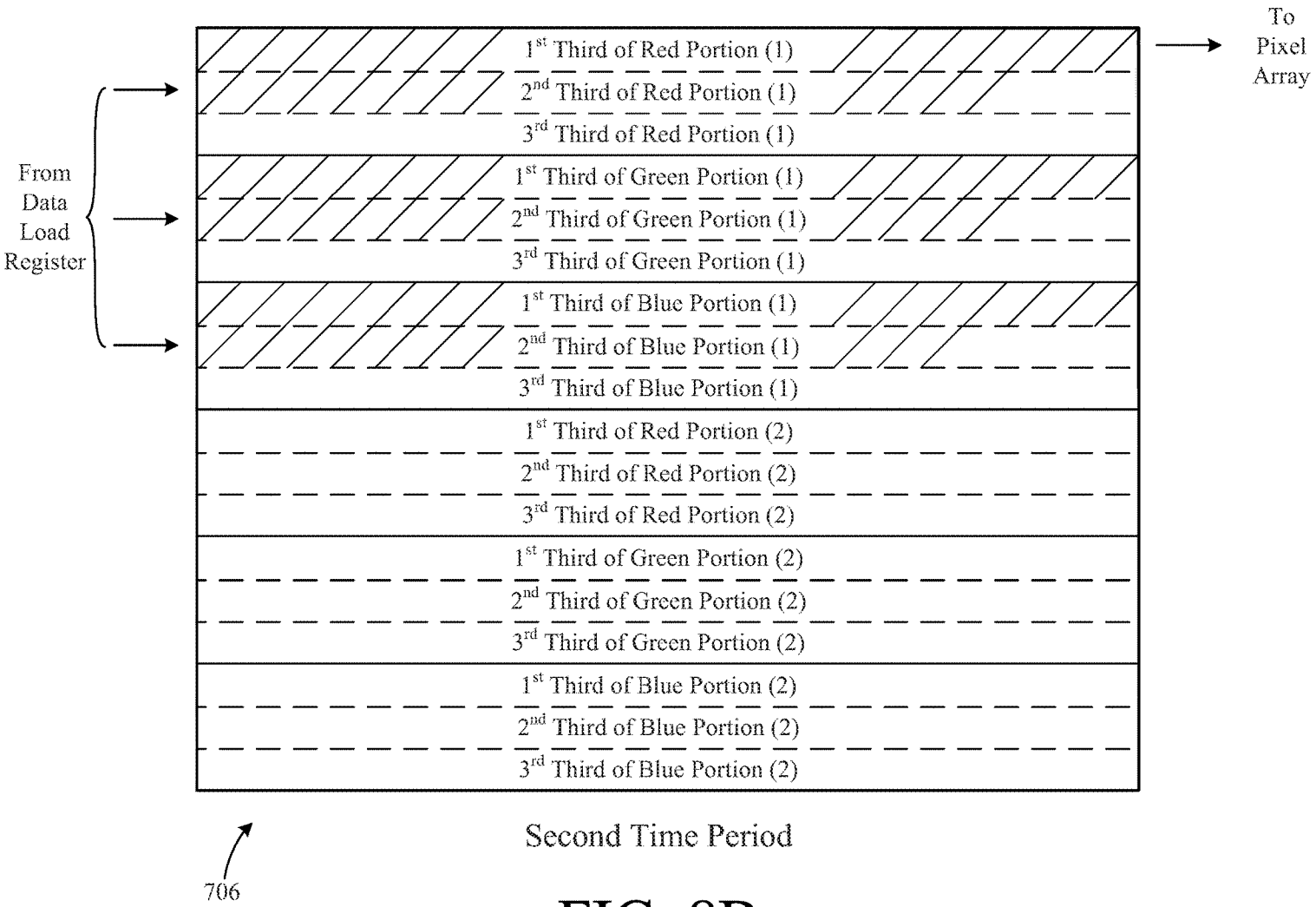

FIG. 8B shows data being written to and read from data buffer 706 during a second time period. A second third of the data of the first frame is being written to the second third of each of the first colored portions. Because the first third of the first frame was written into data buffer 706 during the first time period, the first third of the red color field of the first frame can be transferred to pixel array 708 and displayed during the second time period. Initially displaying only the first third of the image data facilitates a significant reduction in the latency period.

Figure 8C:
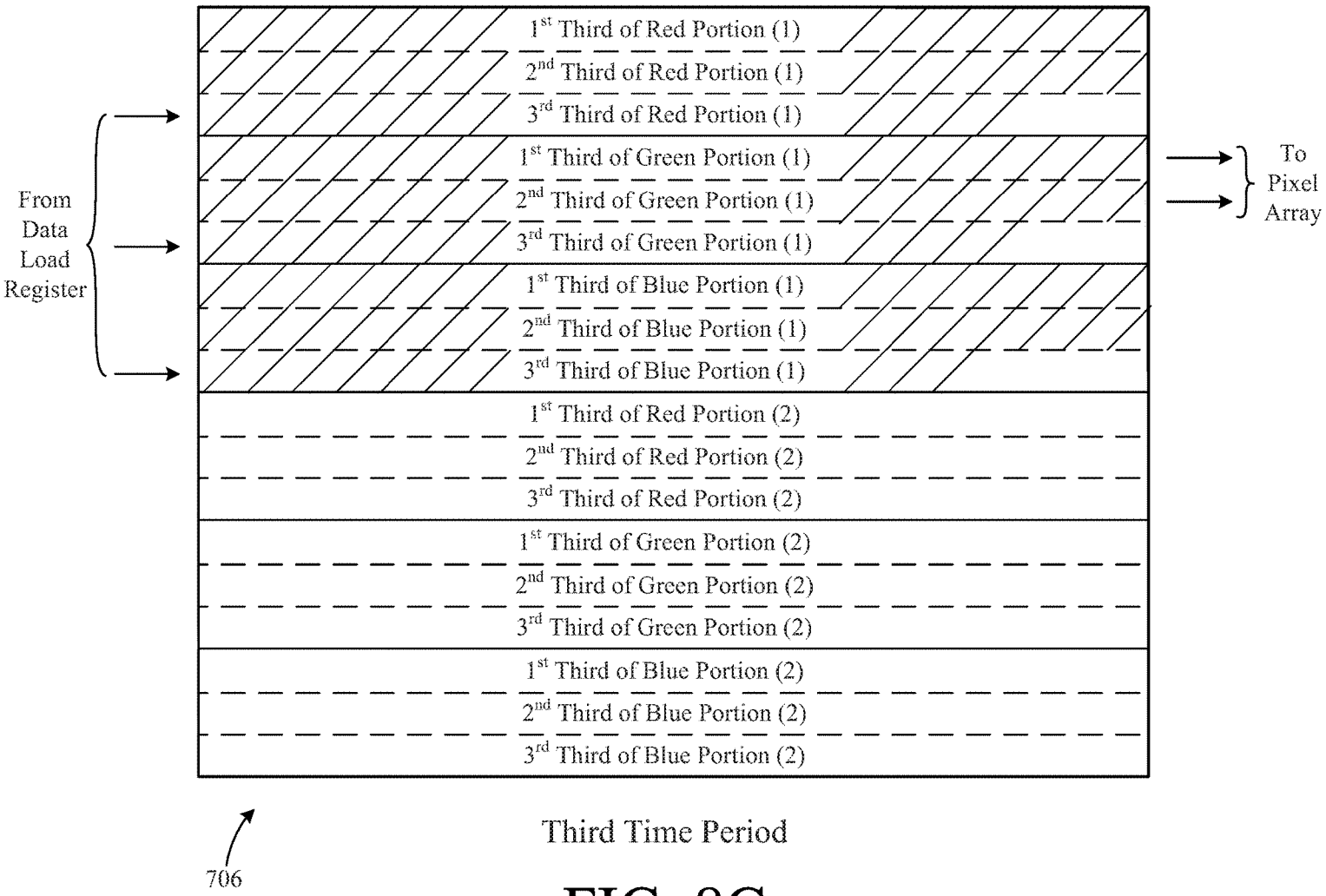

FIG. 8C shows data being written to and read from data buffer 706 during a third time period. The final third of the data of the first frame is being written to the third of each of the first colored portions. Because the second third of the first frame was written during the second time period, the first two-thirds of the green color field of the first frame can be transferred to pixel array 708 and displayed during the third time period.

Figure 8D:
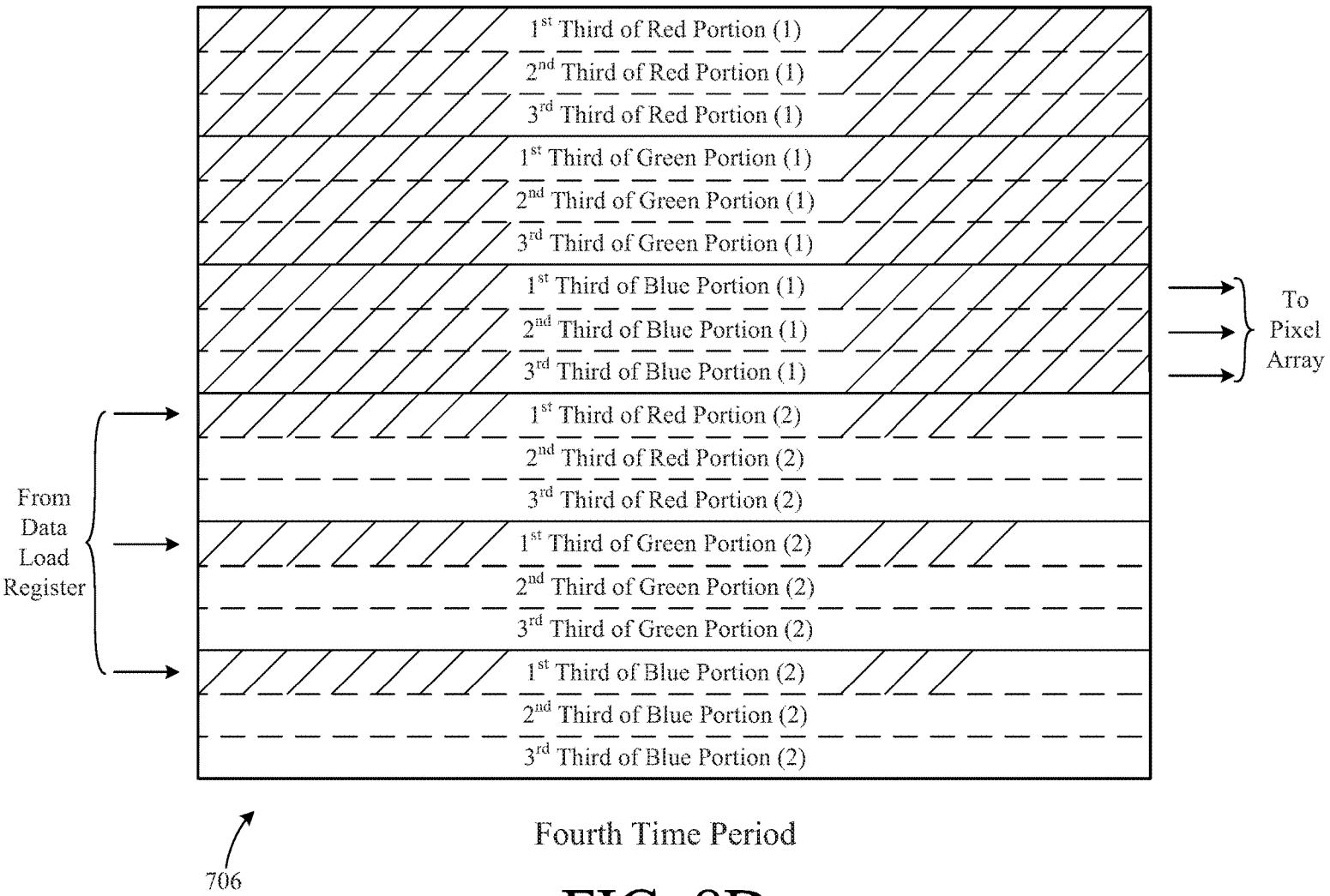

FIG. 8D shows data being written to and read from data buffer 706 during a fourth time period. A first third of the data of the second frame is being written to the first third of each of the second colored portions. Because the third of the first frame was written during the third time period, the entire blue color field of the first frame can be transferred to pixel array 708 and displayed during the fourth time period.

Figure 8E:
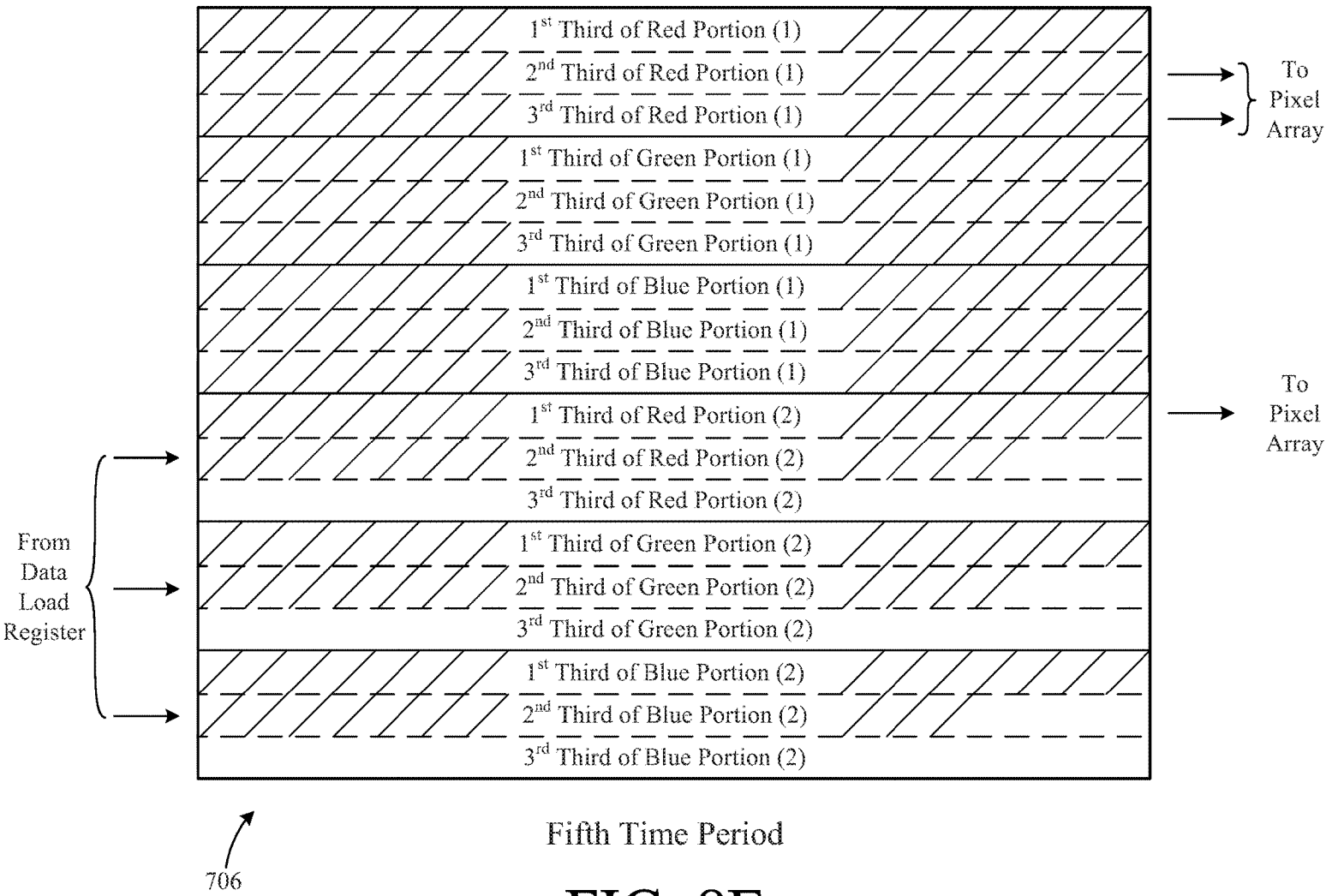

FIG. 8E shows data being written to and read from data buffer 706 during a fifth time period. A second third of the data of the second frame is being written to the second third of each of the second colored portions. Because the first third of the second frame was written during the fourth time period, the first third of the red color field of the second frame and the previously un-displayed two-thirds of the red color field of the first frame are transferred to pixel array 708 and displayed as a single red color field during the fifth time period. Displaying portions of different frames at the same time allows all of the video data to be displayed, and the latency is reduced to only one-third of the latency of conventional systems.

Figure 8F:
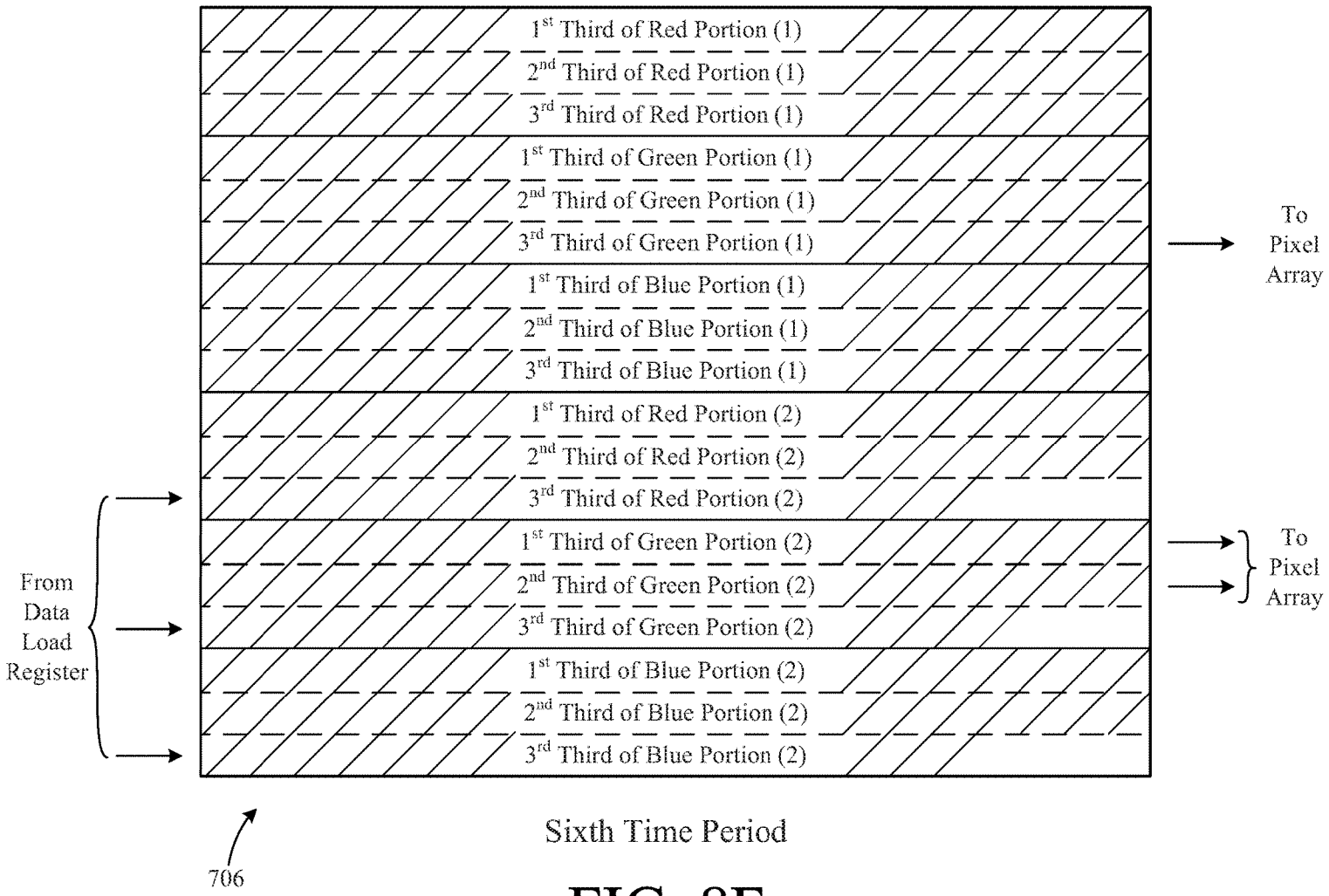

FIG. 8F shows data being written to and read from data buffer 706 during a sixth time period. The final third of the data of the second frame is being written to the third of each of the second colored portions. Because the second third of the second frame was written during the fifth time period, the first two-thirds of the green color field of the second frame and the previously un-displayed third of the green color field of the first frame are transferred to pixel array 708 and displayed as a single green color field during the sixth time period.

Figure 8G:
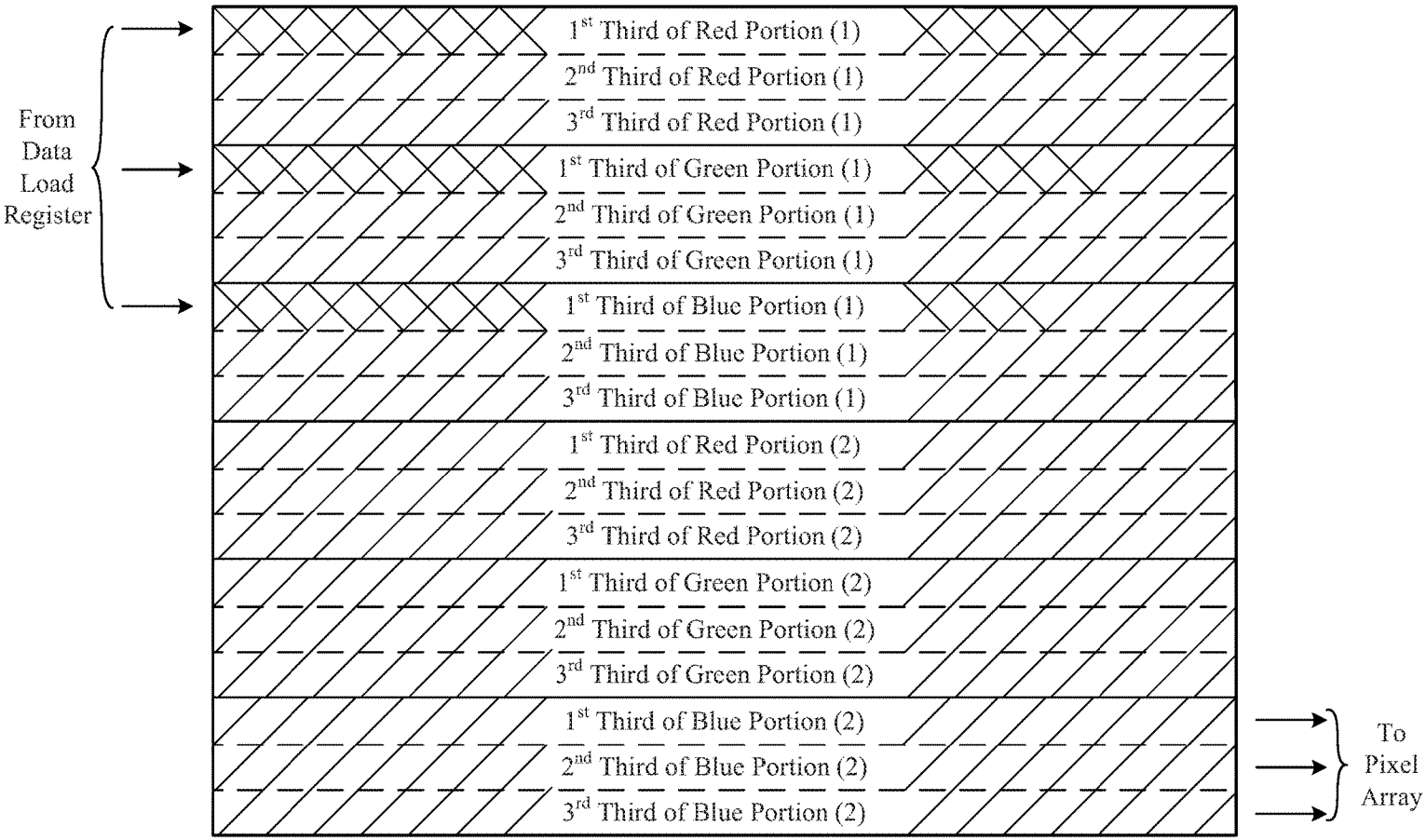

FIG. 8G shows data being written to and read from data buffer 706 during a seventh time period. A first third of the data of a third frame (represented by "X"s) is being written to the first third of each of first colored portions 800(1), 802(1), and 804(1). Because the third of the second frame was written into data buffer 706 during the sixth time period, the entire blue color field of the second frame is transferred to pixel array 708 and displayed during the seventh time period. As data of previous frames is overwritten by new frame data in data buffer 706, the process of combining portions of separate frames and displaying them as single color fields continues. For example, data from the second frame and the third frame will be combined into a single red color field and a single green color field. The same will happen for data from the third frame and the fourth frame and so on.

Those skilled in the art will recognize that the division of the data into thirds is not an essential element of the present invention. For example, the present invention may be practiced by displaying frames in quarters instead of thirds. Instead of displaying the blue portions of frame data in individual blue color fields, the blue portions would be split into three quarters of new frame data and one quarter of old frame data. Likewise, the green fields would be split in half, and the red fields would consist of one quarter of new frame data and three quarters of old frame data. This implementation would further decrease the latency, and is explained in more detail with reference to FIG. 9C. As another alternative, a smaller frame buffer, only large enough to hold a single frame of image data, can be used. Utilizing a smaller frame buffer would require over-writing old frame data immediately after it is written to the pixel array 708.

Figure 9A:
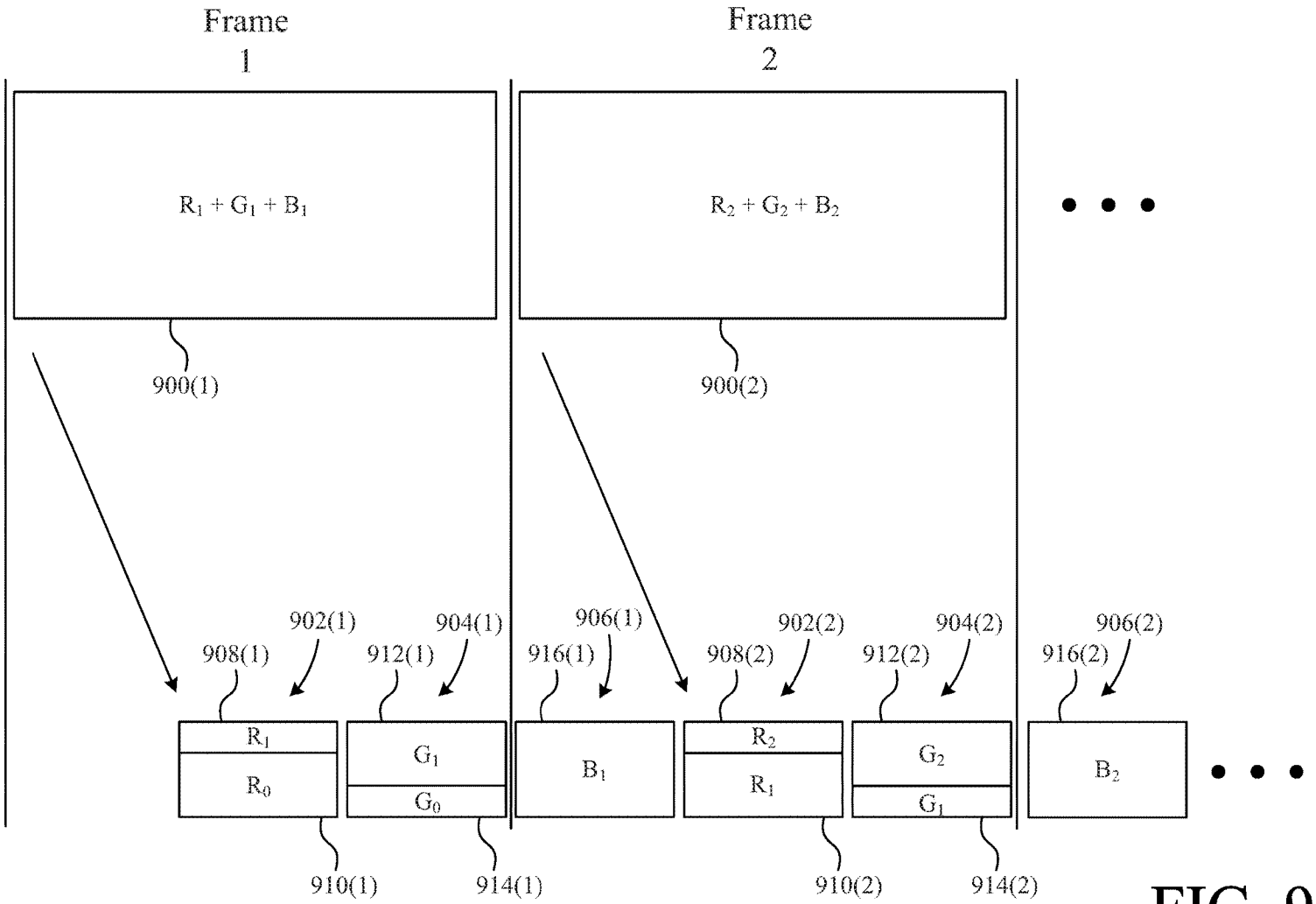
FIGS. 9A-9D are diagrams illustrating the improved latency of the various methods of reading from the data buffer of FIG. 7.

FIG. 9A is a diagram illustrating improved latency of the presently described example embodiment. The diagram is separated into frames 900(1) and 900(2), which both include red, green, and blue data. Because only a third of the data from frame 900(1) is written to data buffer 704 before a first red output field 902(1) is displayed, the latency is reduced to one-third of the frame time.

A first green output field 904(1) and a first blue output field 906(1) are displayed immediately following the display of output field 902(1). Output field 902(1) includes a red portion 908(1) and a prior data portion 910(1). Prior data portions include data from a prior frame or, in the case of an initial frame, random data from the data buffer 706 that is not displayed. Similarly, output field 904(1) includes a green portion 912(1) and a prior data portion 914(1), and output field 906(1) includes a blue portion 914(1). A second red output field 902(2) is displayed following the display of output field 906(1). Output field 902(2) includes a red portion 908(2) of data from frame 900(2), and a red portion 910(2) of data from frame 900(1). A second green output field 904(2), including a green portion 908(2) and a green portion 910(2), is displayed following the display of output field 902(2). Green portion 908(2) includes data from frame 900(2) and green portion 910(2) includes data from frame 900(1). A second blue output field 906(2) is displayed following the display of output field 904(2). Output field 906(2) includes data from frame 900(2). The process of displaying portions of frames as they are written into data buffer 706 continues until there is no more video data to display.

Figure 9B:
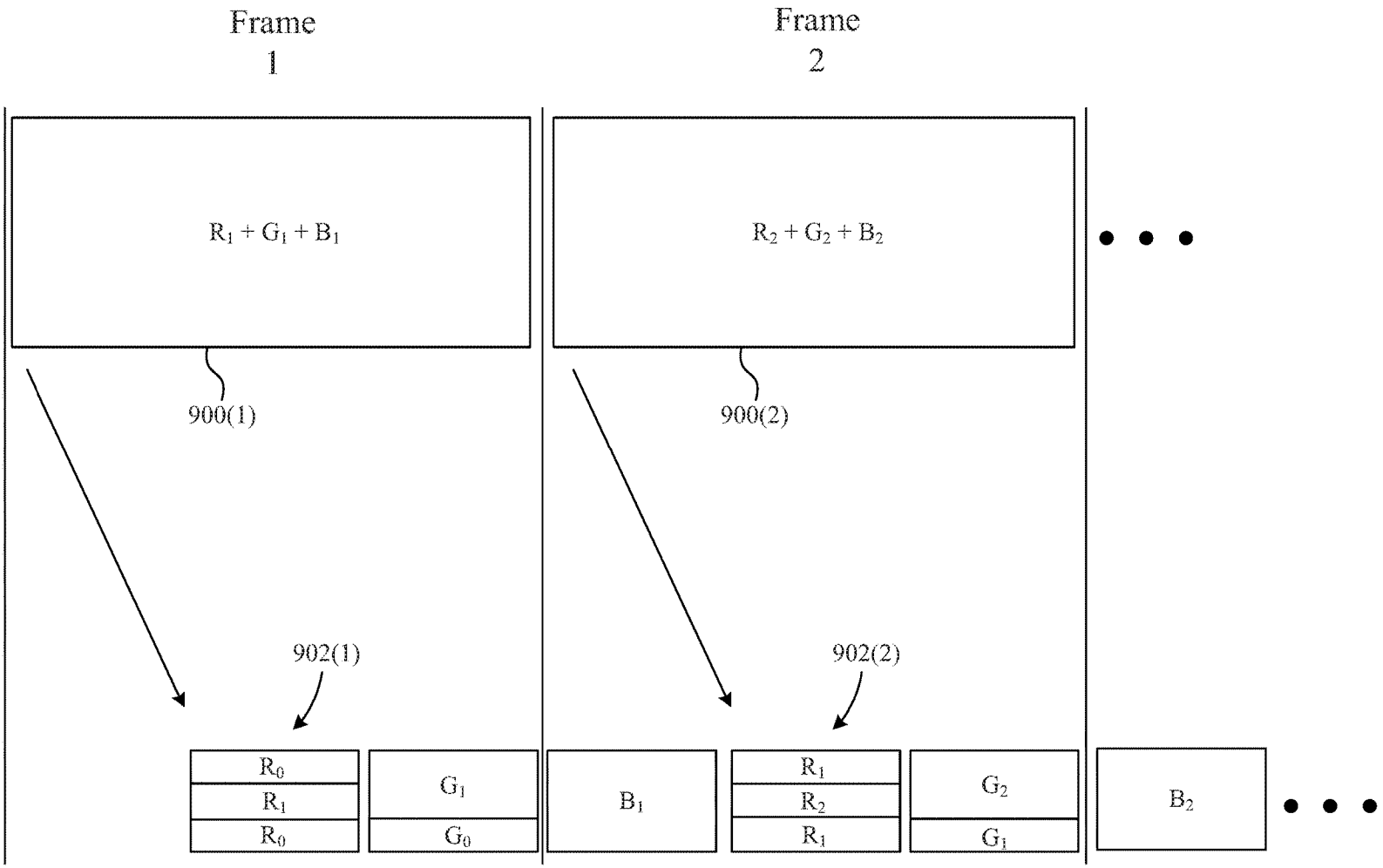

FIG. 9B is a diagram illustrating improved latency of another example method of the present embodiment of the present invention. The diagram is again separated into frames 900(1) and 900(2). However, instead of displaying the top third of output field 902(1) first, the middle third is displayed first. In this example method, host 600 provides the middle rows of data to controller 702 first, then the top rows, and then the bottom rows, which is unconventional. As in the previously described embodiment, the output fields corresponding to the second frame consist of portions of the first frame of data as well as portions of the new frame of data, but in this method, the top and bottom thirds of the display will consist of the previous frame data in output field 902(2). This method is advantageous, because it improves the perceived smoothness of the video data. Because the eye is most often focused on the middle of a screen, it will be less disruptive to display new data on that part of the screen first. This example method differs from the previously described method only in the output of the red fields.

Figure 9C:
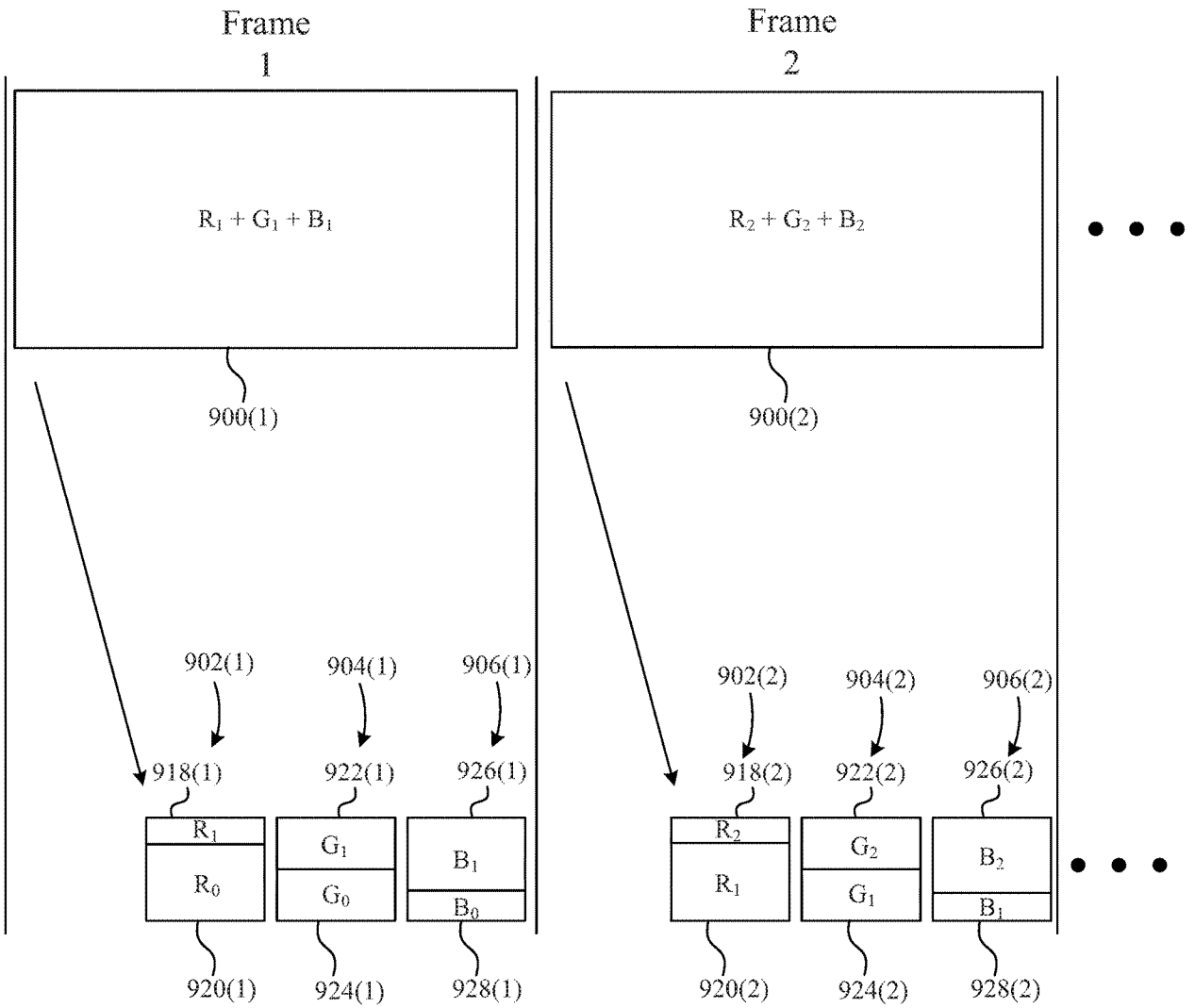

FIG. 9C is a diagram illustrating the improved latency of yet another method of the present invention. The diagram is again separated into frames 900(1) and 900(2). However, instead of displaying output field 902(1) after a third of the image data is written to data buffer 706, it is displayed after only a quarter of the first frame of image data is received. Output field 902(1) is comprised of a red portion 918(1) and a prior data portion 920(1). Red portion 918(1) makes up a quarter of output field 902(1) and prior data portion 920(1) makes up the remaining three quarters. Output field 904(1) is displayed after the next quarter of the first frame of image data is received into data buffer 704 and includes a green portion 922(1) and a prior data portion 924(1). Green portion 922(1) makes up half of output field 904(1) and prior data portion 924(1) makes up the remaining half. Output field 906(1) is written after the next quarter of the first frame of data is written to data buffer 706 and includes a blue portion 926(1) and a prior data portion 928(1). Blue portion 926(1) makes up three fourths of output field 906(1) and prior data portion 928(1) makes up the remaining portion.

Output fields 902(2), 904(2), and 906(2) are displayed in succession following the display of output field 906(1) and a blank (off) time. Output field 902(2) includes a red portion 918(2), which includes image data from a subsequent frame of data, and a red portion 920(2), which replaces prior data portion 920(1) and includes previously un-displayed image data from the previous frame. Output field 904(2) includes a green portion 922(2), which includes image data from the subsequent frame, and a green portion 924(2), which replaces prior data portion 924(2) and includes image data from the previous frame. Output field 906(2) includes a blue portion 926(2), which is comprised of image data from the subsequent frame, and a blue portion 928(2), which replaces prior data portion 928(1) and is comprised of image data from the previous frame. The process of displaying portions of frames as they are written into data buffer 706 continues until there is no more video data to display.

Figure 9D:
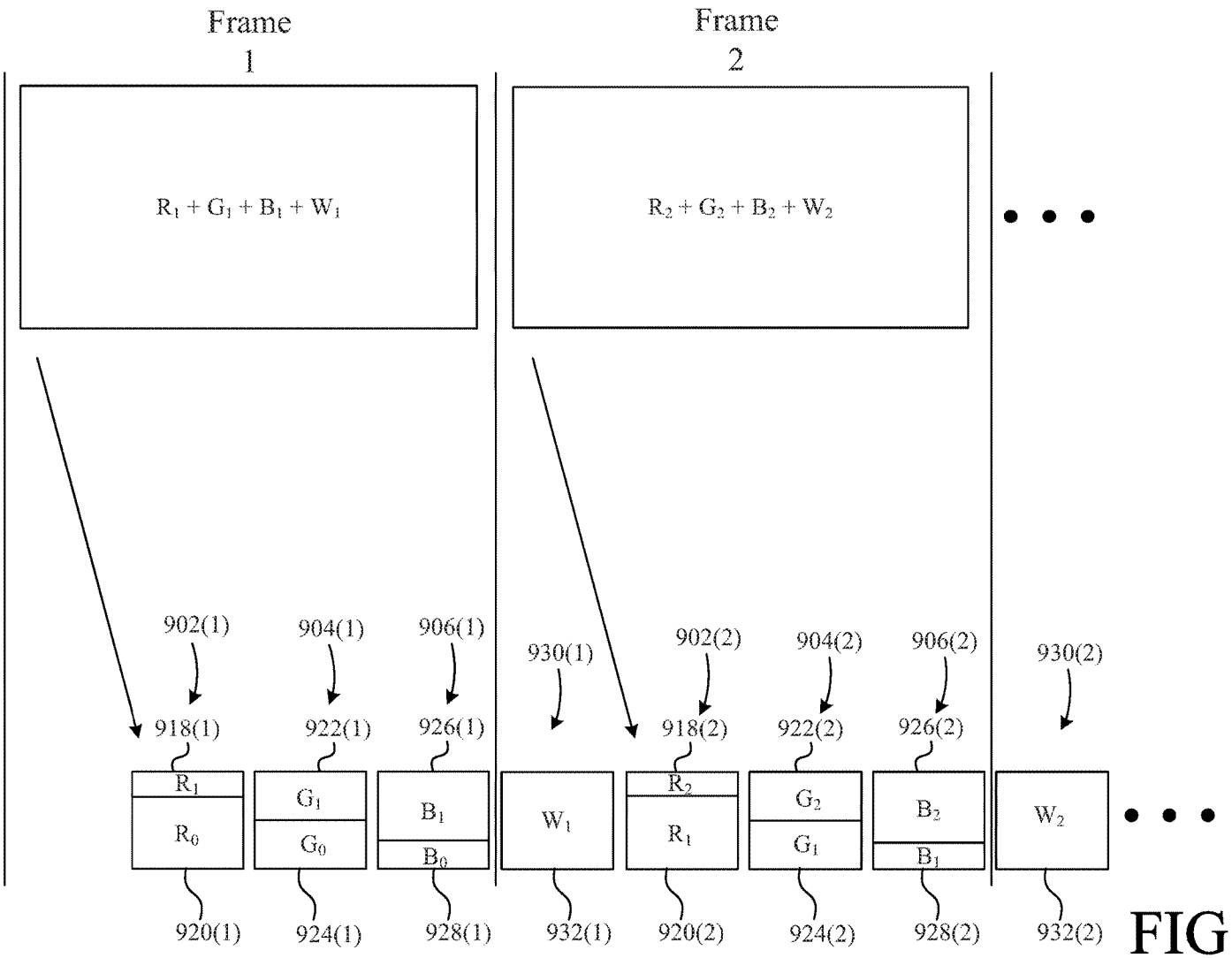

FIG. 9D is a diagram illustrating the improved latency of yet another method of the present invention. The method of FIG. 9D is similar to that of FIG. 9C in that the latency is approximately 25% of a frame time. However, the method of FIG. 9D, introduces a fourth output field 930, which uses the blank time in the method of FIG. 9C. In this example, the fourth color is white, and output filed 930(1) includes a white portion 932(1) from frame 901(1). Similarly, output filed 930(2) includes a white portion 932(2) from frame 901(2). The use of white as the fourth color provides additional advantages including, but not limited to, increasing the dynamic range of the display. Optionally, the use of a fourth color (e.g., other than white) will increase the color gamut of the display and can facilitate the display of higher color gamut input.

The use of the fourth output field 930 facilitates options other than the use of another color field. For example, the fourth color field can be used to display data of one (e.g. green) of the original three colors twice for each frame to implement an RGBG scheme. When the same green data is displayed twice in a frame, the intensity of the green light source is dimmed to achieve the proper over all intensity of the green field. As yet another option, the fourth field can facilitate the display of additional numbers of bits for one of the colors, in order to accommodate higher resolution input data.

Figure 10:
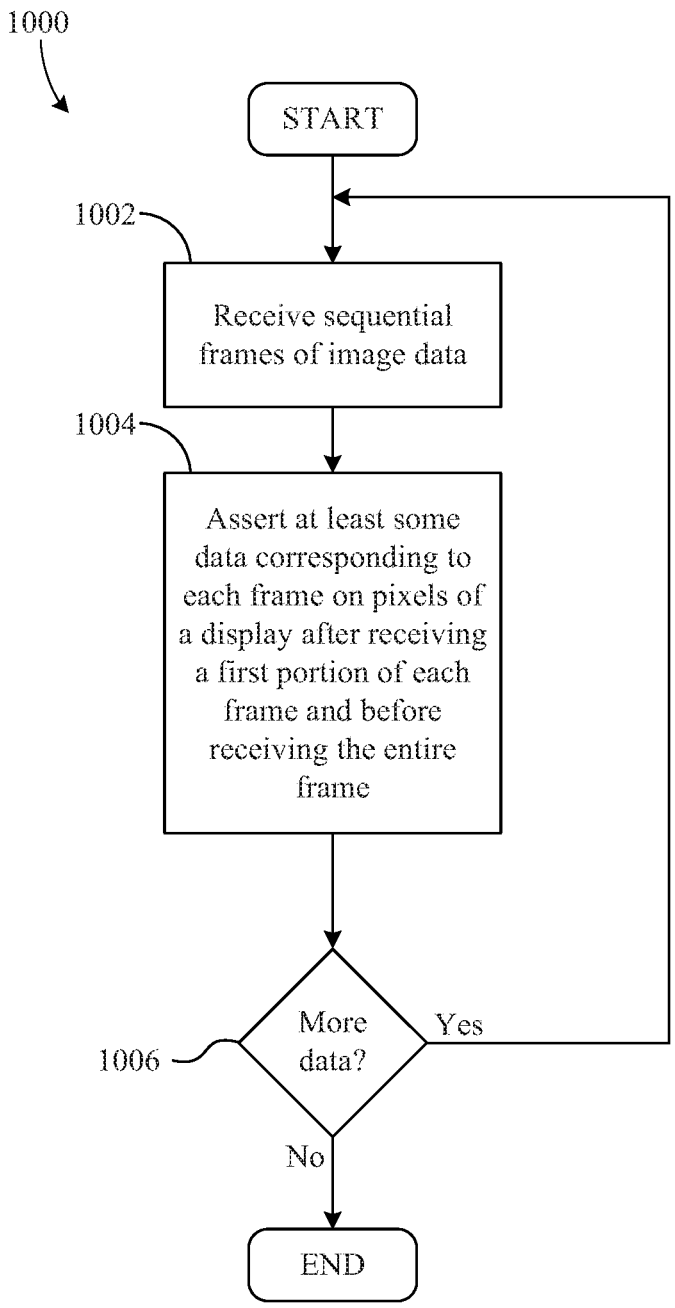
FIG. 10 is a flow chart summarizing an example method of writing data to a display.

FIG. 10 is a flowchart summarizing an example method 1000 for displaying sequential frames of image data. In a first step 1002, sequential frames of image data are received. Then, in a second step 1004, at least some data corresponding to each frame of the image data is asserted on pixels of a display. The data is asserted after receiving a first portion of each frame of data and before receiving the entire portion of the second frame of data. In a third step 1006, it is determined whether there is more data to be received. If there is more data to be received, method 1000 returns to step 1002. If there is no more data to be received method 1000 ends.

Figure 11:
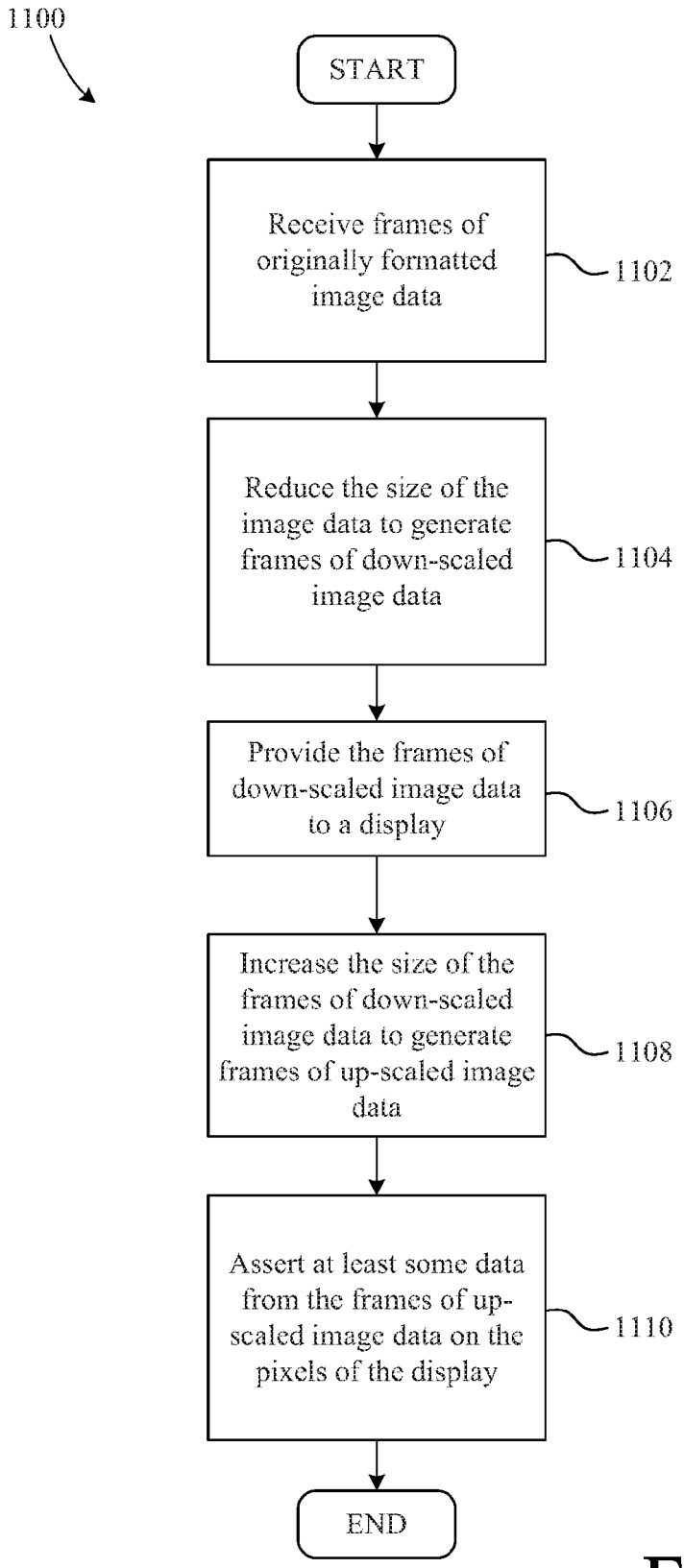
FIG. 11 is a flow chart summarizing an alternate method of writing data to a display.

FIG. 11 is a flowchart summarizing an example method 1100 for displaying sequential frames of image data. In a first step 1102, frames of originally formatted image data are received. Next, in a second step 1104, the size of the image data is reduced to generate frames of down-scaled image data. There are several possible methods for executing step 1104. One such method is to omit image data corresponding to predetermined rows or columns of pixels on a display. This method can include omitting every other row or column, every third row or column, and so on. In a third step 1106, the frames of down-scaled image data are provided to a display. Next, in a fourth step 1108 the size of the frames of down-scaled image data is increased to generate up-scaled image data. Finally, in a fifth step 1110, at least some data from the frames of up-scaled image data is asserted on the pixels of the display.

Figure 12:
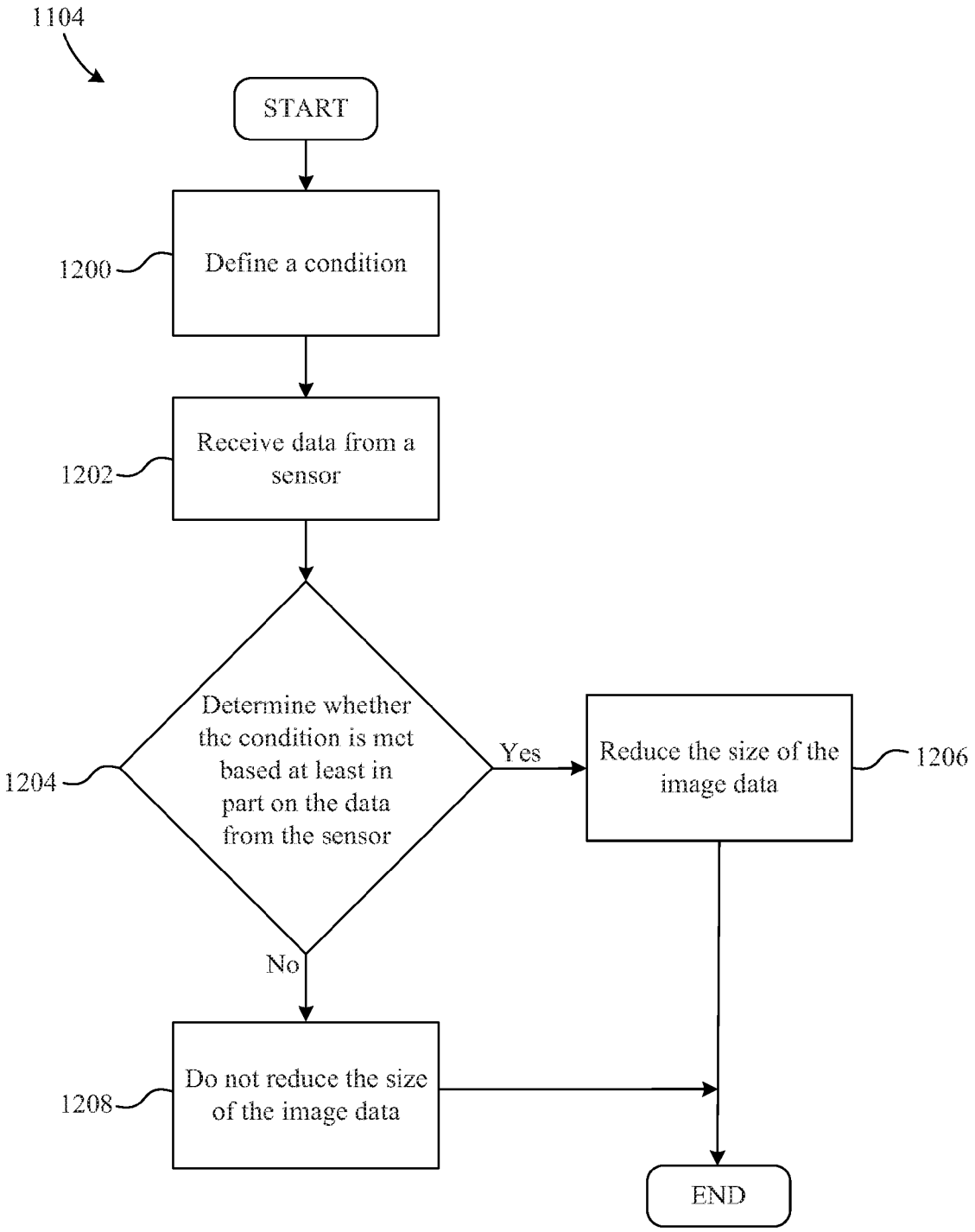
FIG. 12 is a flow chart summarizing an example method of performing a second step 1104 of the method of FIG. 11.

FIG. 12 is a flow chart summarizing an example method of performing step 1104 of method 1100. This step can be implemented with or without other previously described methods. In a first step 1200, a condition is defined. Then, in a second step 1202, data is received from a sensor. Next, in a third step 1204, it is determined whether or not the condition of step 1200 is met based at least in part on the data from the sensor. If the condition is met, the method proceeds to a fourth step 1206, during which the size of the image data is reduced and the method ends. If the condition is not met, the method proceeds to a fifth step 1208, during which the size of the data is not reduced and the method ends.

In the present embodiment, the data received from the sensor makes up at least part of the criteria for determining whether or not the condition of step 1200 is met. Those skilled in the art will recognize, however, that there are a number of possible criteria for making the determination of step 1204. For example, the determination can be made based solely on the image data. Alternatively, the determination can be made based on user input. Ultimately, any criteria that bear upon the quality of the displayed video can be used to make the determination of step 1204.

Figure 13A:
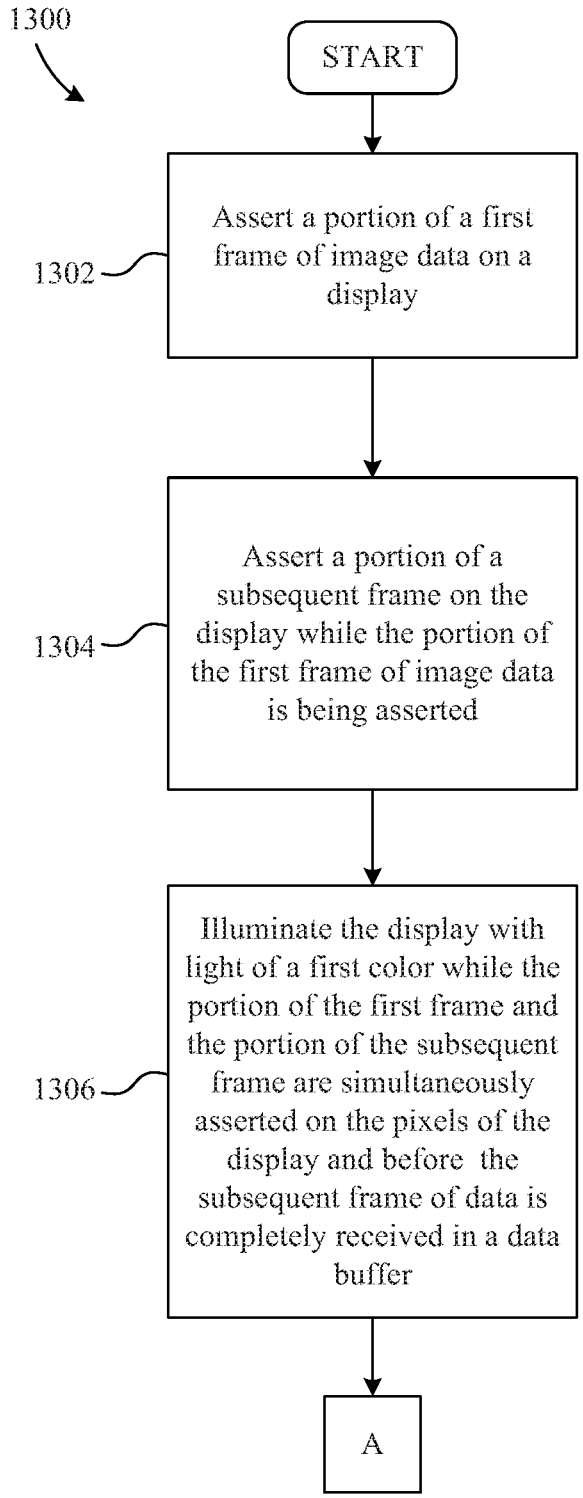
FIGS. 13A-C are sections of a flow chart summarizing another example method of writing data to a display.
Figure 13B:
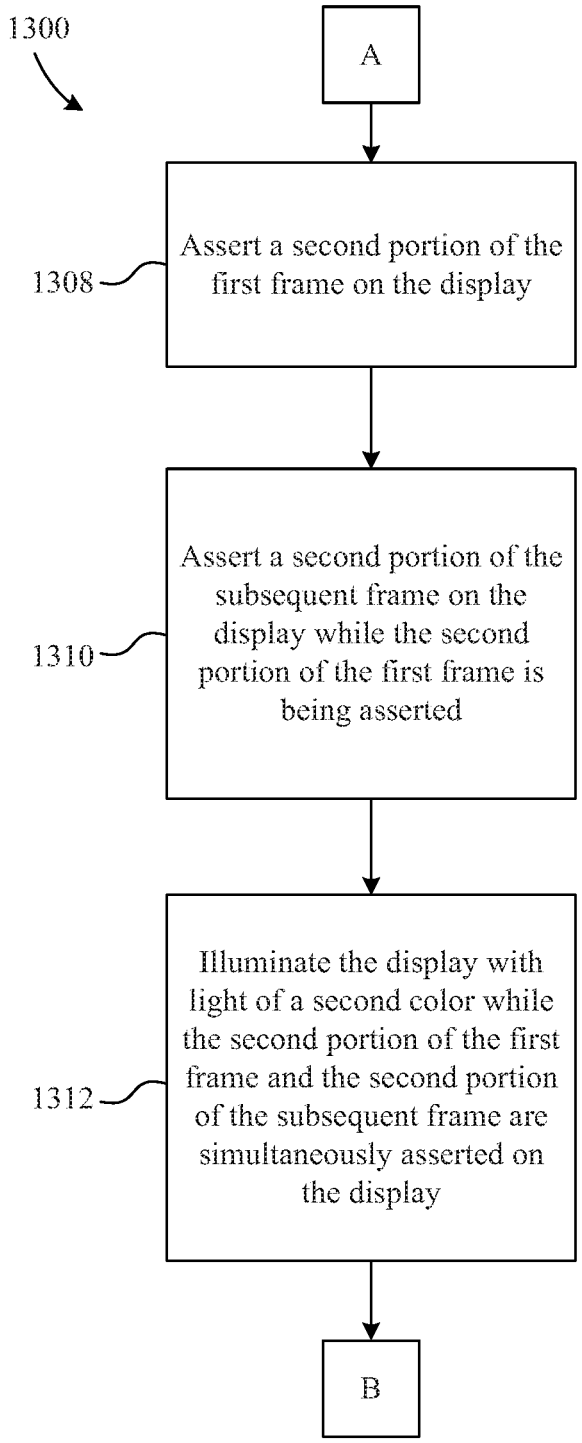
Figure 13C:
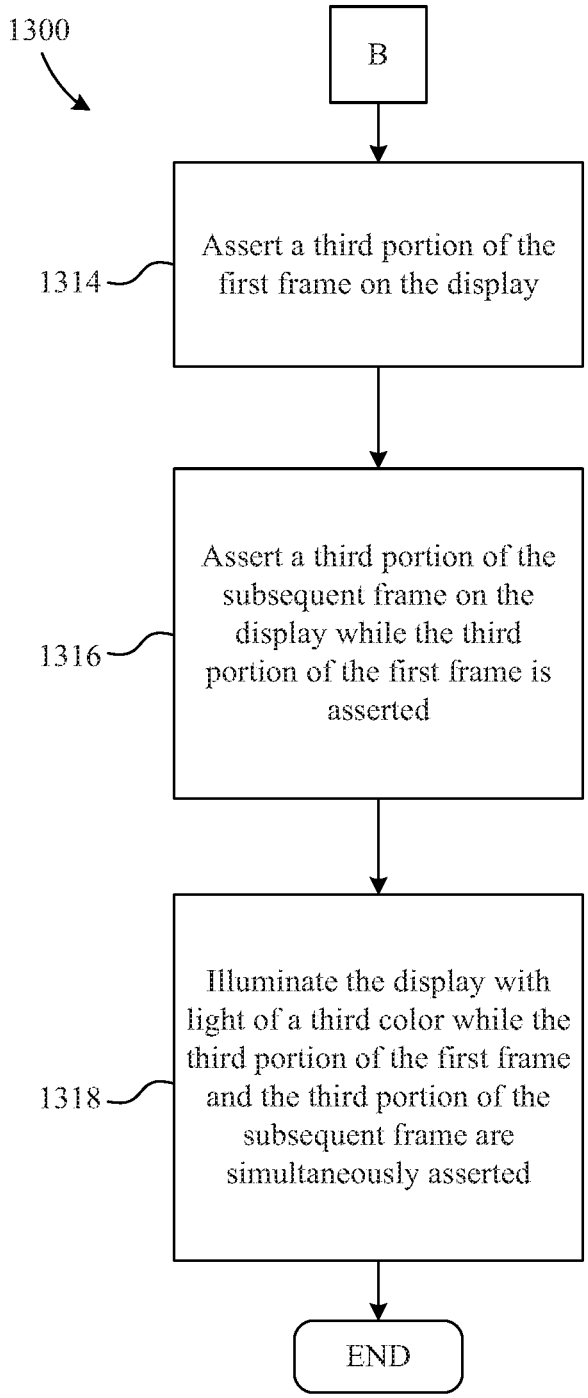

FIGS. 13A-13C are a flow chart showing another example method 1300 for displaying sequential frames of image data. In a first step 1302 (FIG. 13A), a portion of a first frame of image data is asserted on a display. Next, in a second step 1304, a portion of a subsequent frame is asserted on the display while the portion of the first frame of data is being asserted. Then, in a third step 1306, the display is illuminated with light of a first color while the portion of the first frame of data and the portion of the subsequent frame of data are simultaneously asserted on the pixels of the display and before the subsequent frame of data is completely received in a data buffer. Next, in a fourth step 1308 (FIG. 13B), a second portion of the first frame of data is asserted on the display. Then, in a fifth step 1310, a second portion of the subsequent frame of data is asserted on the display while the second portion of the first frame of data is being asserted. Next, in a sixth step 1312 the display is illuminated with light of a second color while the second portion of the first frame of data and the second portion of the subsequent frame of data are simultaneously asserted on the display. Then, in a seventh step 1314 (FIG. 13C), a third portion of the first frame of data is asserted on the display. Next, in an eighth step 1316, a third portion of the subsequent frame of data is asserted on the display while the third portion of the first frame of data is asserted. Finally, in a ninth step 1318, the display is illuminated with light of a third color while the third portion of the first frame of data and the third portion of the subsequent frame of data are simultaneously asserted.

Figure 14A:
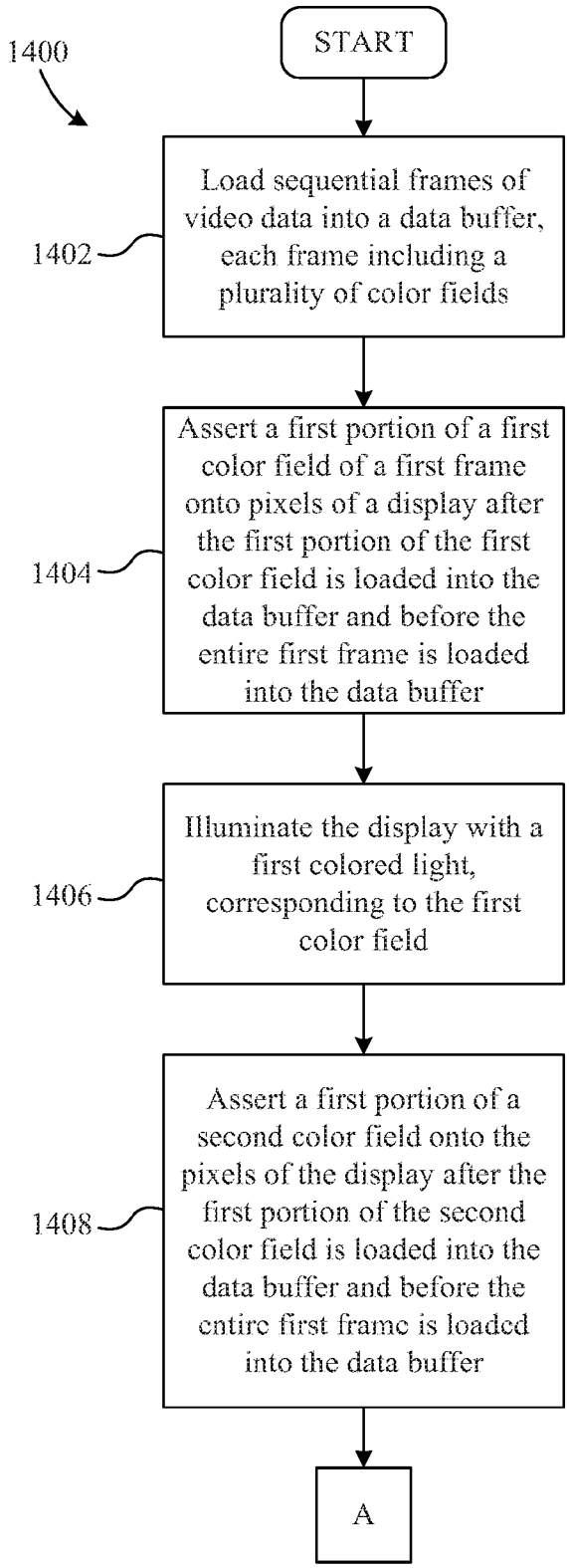
FIGS. 14A-C are sections of a flow chart summarizing yet another example method of writing data to a display.
Figure 14B:
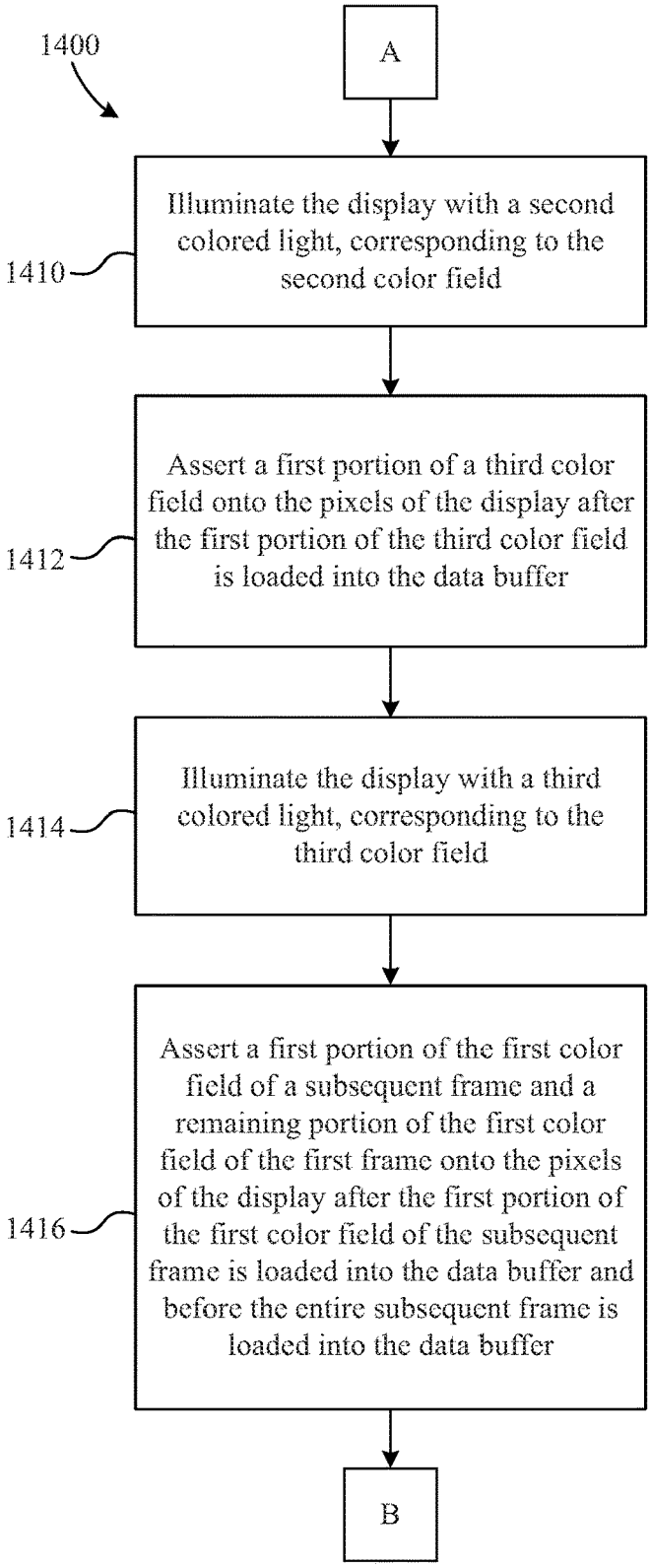
Figure 14C:
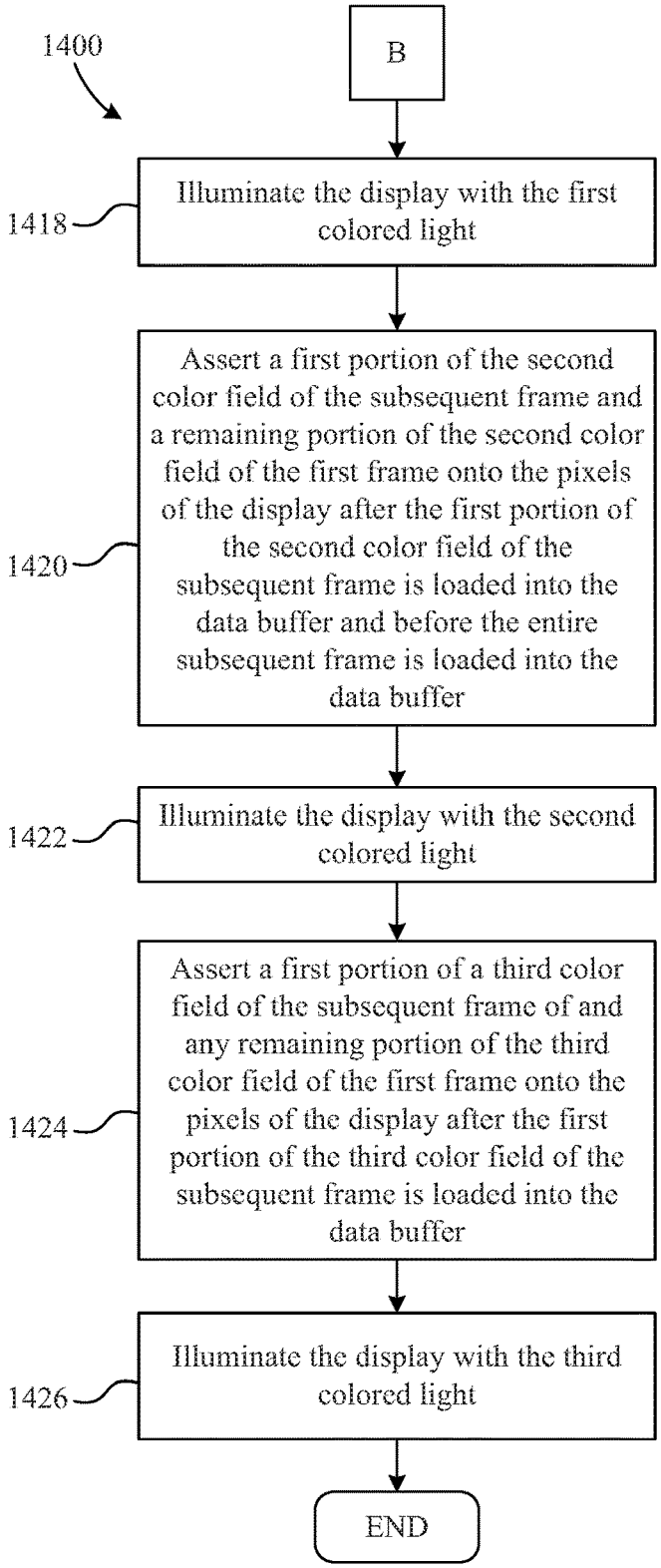

FIGS. 14A-14C are a flow chart summarizing another example method 1400 for displaying sequential frames of image data. In a first step 1402 (FIG. 14A), sequential frames of video data are loaded into a data buffer, each frame including a plurality of color fields. Next, in a second step 1404, a first portion of a first color field of a first frame of data is asserted onto pixels of a display after the first portion of the first color field is loaded into the data buffer and before the entire frame of data is loaded into the data buffer. Then, in a third step 1406, the display is illuminated with light of a first color, corresponding to the first color field. Next, in a fourth step 1408, a first portion of a second color field is asserted onto the pixels of the display after the first portion of the second color field is loaded into the data buffer and before the entire frame of data is loaded into the data buffer. Then, in a fifth step 1410 (FIG. 14B), the display is illuminated with light of a second color, corresponding to the second color field. Next, in a sixth step 1412, a first portion of a third color field is asserted onto the pixels of the display after the first portion of the third color field is loaded into the data buffer. Then, in a seventh step 1414, the display is illuminated with light of a third color, corresponding to the third color field. Next, in an eighth step 1416, a first portion of the first color field of a subsequent frame of data and a remaining portion of the first color field of the first frame of data are asserted onto the pixels of the display after the first portion of the first color field of the subsequent frame of data is loaded into the data buffer and before the entire subsequent frame of data is loaded into the data buffer. Then, in a ninth step 1418 (FIG. 14C), the display is illuminated with light of the first color. Next, in a tenth step 1420, a first portion of the second color field of the subsequent frame of data and a remaining portion of the second color field of the first frame of data are asserted onto the pixels of the display after the first portion of the second color field of the subsequent frame of data is loaded into the data buffer and before the entire subsequent frame of data is loaded into the data buffer. Then, in an eleventh step 1422, the display is illuminated with light of the second color. Next, in a twelfth step 1424, a first portion of a third color field of the subsequent frame of data and a remaining portion (if any) of the third color field of the first frame of data are asserted onto the pixels of the display after the first portion of the third color field of the subsequent frame of data is loaded into the data buffer. Finally, in a thirteenth step 1426, the display is illuminated with light of the third color.

The description of particular embodiments of the present invention is now complete. Many of the described features may be substituted, altered or omitted without departing from the scope of the invention. For example, alternate data buffers, may be substituted for the data buffers described in FIGS. 3 & 7. Specifically, two smaller data buffers can be used in place of the single data buffer as described. Additionally, only a single smaller data buffer can be used in conjunction with appropriate data transfer techniques. As another example, the new portions of each frame can be displayed from the bottom of the pixel array first, instead of from the top. Alternately, the new portions can be displayed from the middle of the pixel array first. As yet another example, down-scaled image data can be stored in the frame buffer and up-scaled as it is transferred to the display pixels, as opposed to being up-scaled as it is written into the frame buffer. These and other deviations from the particular embodiments shown will be apparent to those skilled in the art, particularly in view of the foregoing disclosure.

I claim:

1. A display system, comprising:

a display including a plurality of individual pixels; and a display driver coupled to receive sequential frames of image data and to assert at least a portion of said image data on said pixels of said display; and wherein said display driver asserts at least some data corresponding to a frame of said image data on said pixels of said display within a predetermined amount of time after receiving a first portion of said frame of said image data; and said predetermined amount of time is less than an amount of time required for said display driver to receive a full frame of said image data; and an image data buffer electrically coupled to receive said sequential frames of image data and to provide said sequential frames of image data to said display; and wherein said display driver is operative to assert a portion of a frame of image data on a first set of said pixels of said display, assert a portion of a subsequent frame of image data on a second set of pixels of said display while said portion of said frame of image data is being asserted on said first set of pixels, and cause said display to be illuminated with light of a first color while said portion of said frame of image data and said portion of said subsequent frame of image data are being simultaneously asserted on said pixels of said display and before all of said subsequent frame of image data is received in said image data buffer;

one of said first set of pixels and said second set of pixels includes some, but not all, of said pixels of said display; and the other of said first set of pixels and said second set of pixels includes the remainder of said pixels of said display.

2. The display system of claim 1, further comprising:

an image data scaler electrically coupled to receive said frames of image data each including a particular amount of data, operative to reduce the size of said image data to generate down-scaled frames of image data each including less than said particular amount of data, and operative to provide said down scaled frames of image data to said display driver; and wherein said display driver is electrically coupled to receive said down-scaled frames of image data from said image data scalar, is operative to increase the size of said down-scaled frames of image data to generate up-scaled frames of image data, and is operative to assert at least some data from each of said up-scaled frames of image data on pixels of said display before receiving an amount of data corresponding to said particular amount of data.

3. The display system of claim 2, wherein said down-scaled image data includes no more than 75% of the amount of image data in a frame of said originally formatted image data.

4. The display system of claim 3, wherein said down-scaled image data includes no more than 50% of the amount of image data in a frame of said originally formatted image data.

5. The display system of claim 2, wherein said image data scaler is operative to generate said down-scaled image data by omitting data values associated with particular pixels of said display from said originally formatted image data.

6. The display system of claim 2, wherein said image data scaler is operative to generate said down-scaled image data by omitting data values associated with predefined rows of pixels of said display from said originally formatted image data.

7. The display system of claim 2, further comprising an electronic controller configured to provide control signals to dynamically transition said image data scaler between an on-state and an off-state.

8. The display system of claim 7, further comprising:

a sensor; and wherein said controller, responsive to data from said sensor, transitions said image data scaler between said on-state and said off-state.

9. The display system of claim 8, wherein said sensor is an image sensor.

10. The display system of claim 8, wherein said sensor is a motion sensor.

11. The display system of claim 8, wherein said sensor is an orientation sensor.

12. The display system of claim 1, wherein said portion of said frame of image data is larger than said portion of said subsequent frame of image data.

13. The display system of claim 1, wherein said display driver is further operative to:

assert a second portion of said frame of image data on a third set of said pixels of said display;

assert a second portion of said subsequent frame of image data on a fourth set of pixels of said display while said second portion of said frame of image data is being asserted on said third set of pixels; and cause said display to be illuminated with light of a second color while said second portion of said frame of image data and said second portion of said subsequent frame of image data are being simultaneously asserted on said pixels of said display.

14. The display system of claim 13, wherein said second portion of said frame of image data is smaller than said second portion of said subsequent frame of image data.

15. The display system of claim 13, wherein said display driver is further operative to:

assert a third portion of said subsequent frame of image data on all of said pixels of said display; and cause said display to be illuminated with light of a third color while said third portion of said subsequent frame of image data is asserted on all of said pixels of said display.

16. The display system of claim 1, wherein:

said one of said first set of pixels and said second set of pixels includes one-third of said pixels of said display; and the other of said first set of pixels and said second set of pixels includes two-thirds of said pixels of said display.

17. The display system of claim 1, wherein said one of said first set of pixels and said second set of pixels includes a middle one-third of said pixels of said display.

18. The display system of claim 1, wherein:

said one of said first set of pixels and said second set of pixels includes one-fourth of said pixels of said display; and the other of said first set of pixels and said second set of pixels includes three-fourths of said pixels of said display.

19. The display system of claim 1, wherein said display driver asserts at least some data corresponding to a current frame of said image data on said pixels of said display while other data of said current frame is still being received.

20. The display system of claim 1, wherein:

each frame of said image data is received during a corresponding frame time; and said at least some data corresponding to each frame is asserted on said pixels of said display during said corresponding frame time.

21. The display system of claim 1, wherein:

one of said first set of pixels and said second set of pixels includes one-fourth of said pixels of said display; and said first set of pixels and said second set of pixels together include all of said pixels of said display.

22. In a digital display system, a method for displaying digital data, said method comprising:

receiving sequential frames of image data;

asserting at least some data corresponding to a frame of said image data on pixels of a display within a predetermined amount of time after receiving a first portion of said frame of said image data;

asserting a portion of a frame of image data on a first set of said pixels of said display;

asserting a portion of a subsequent frame of image data on a second set of said pixels of said display while said portion of said frame of image data is being asserted on said first set of pixels, and causing said display to be illuminated with light of a first color while said portion of said frame of image data and said portion of said subsequent frame of image data are being simultaneously asserted on said pixels of said display and before all of said subsequent frame of image data is received in said image data buffer;

wherein said predetermined amount of time is less than an amount of time required to receive each full frame of said image data;

one of said first set of pixels and said second set of pixels includes some, but not all, of said pixels of said display; and the other of said first set of pixels and said second set of pixels includes the remainder of said pixels of said display.

23. The method of claim 22, further comprising:

receiving frames of originally formatted image data each including a particular amount of data;

reducing the size of said image data to generate frames of down-scaled image data each including less than said particular amount of data;

providing said frames of down-scaled image data to a display;

increasing the size of said frames of down-scaled image data to generate frames of up-scaled image data; and asserting at least some data from each of said frames of up-scaled image data on pixels of said display before receiving an amount of data corresponding to said particular amount of data.

24. The method of claim 23, further comprising:

asserting at least some data of each frame of said up-scaled image data on said pixels of said display within a certain amount of time after receiving a first portion of each frame of said down-scaled image data; and wherein said certain amount of time is less than an amount of time required for said display to receive a frame of said originally formatted image data.

25. The method of claim 23, wherein said step of reducing the size of said image data to generate frames of down-scaled image data includes generating frames of down-scaled image data each including no more than 75% of the amount of image data in a frame of said originally formatted image data.

26. The method of claim 25, wherein said step of reducing the size of said image data to generate frames of down-scaled image data includes generating frames of down-scaled image data including no more than 50% of the amount of image data in a frame of said originally formatted image data.

27. The method of claim 23, wherein said step of reducing the size of said image data to generate frames of down-scaled image data includes omitting data values associated with particular pixels of said display from said originally formatted data.

28. The method of claim 23, wherein said step of reducing the size of said image data to generate frames of down-scaled image data includes omitting data values associated with predefined rows of pixels of said display from said originally formatted data.

29. The method of claim 23, wherein said step of reducing the size of said image data includes:

reducing the size of said image data when a predefined condition is met; and not reducing the size of said image data when said predefined condition is not met.

30. The method of claim 29, wherein said step of reducing the size of said image data includes:

receiving data from a sensor;

determining whether said condition is met based at least in part on said data from said sensor.

31. The method of claim 30, wherein said step of receiving data from a sensor includes receiving data from an image sensor.

32. The method of claim 30, wherein said step of receiving data from a sensor includes receiving data from a motion sensor.

33. The method of claim 30, wherein said step of receiving data from a sensor includes receiving data from an orientation sensor.

34. The method of claim 22, wherein said portion of said frame of image data is larger than said portion of said subsequent frame of image data.

35. The method of claim 22, further comprising:

asserting a second portion of said frame of image data on a third set of said pixels of said display;

asserting a second portion of said subsequent frame of image data on a fourth set of said pixels of said display while said second portion of said frame of image data is being asserted on said third set of pixels; and causing said display to be illuminated with light of a second color while said second portion of said frame of image data and said second portion of said subsequent frame of image data are being simultaneously asserted on said pixels of said display.

36. The method of claim 35, wherein said second portion of said frame of image data is smaller than said second portion of said subsequent frame of image data.

37. The method of claim 35, further comprising:

asserting a third portion of said frame of image data on a fifth set of said pixels of said display;

asserting a third portion of said subsequent frame of image data on a sixth set of said pixels of said display while said third portion of said frame of image data is being asserted on said fifth set of pixels; and causing said display to be illuminated with light of a third color while said third portion of said frame of image data and said third portion of said subsequent frame of image data are being simultaneously asserted on said pixels of said display.

38. The method of claim 37, wherein:

said third portion of said frame of image data includes 0% of said frame of image data;

said third portion of said subsequent frame of image data includes 100% of said subsequent frame of image data;

said fifth set of said pixels of said display includes none of said pixels of said display; and said sixth set of said pixels of said display includes all of said pixels of said display.

39. The method of claim 22, wherein:

one of said first set of pixels and said second set of pixels includes one-third of said pixels of said display; and the other of said first set of pixels and said second set of pixels includes two-thirds of said pixels of said display.

40. The method of claim 22, wherein one of said first set of pixels and said second set of pixels includes a middle one-third of said pixels of said display.

41. The method of claim 22, wherein:

one of said first set of pixels and said second set of pixels includes one-fourth of said pixels of said display; and the other of said first set of pixels and said second set of pixels includes three-fourths of said pixels of said display.

42. The method of claim 22, wherein said step of asserting at least some data corresponding to each frame of image data on pixels of a display includes asserting at least some data corresponding to a current frame of said image data on said pixels of said display while other data of said current frame is still being received.

43. The method of claim 22, wherein:

receiving sequential frames of image data includes receiving each frame of said image data during a corresponding frame time; and said step of asserting at least some data corresponding to each frame of image data on pixels of a display includes asserting said at least some data corresponding to each frame on said pixels of said display during said corresponding frame time.

44. The method of claim 22, wherein:

one of said first set of pixels and said second set of pixels includes one-fourth of said pixels of said display; and said first set of pixels and said second set of pixels together include all of said pixels of said display.

45. In a digital video driver, a method for displaying digital video data, said method comprising:

loading sequential frames of video data into a data buffer, each frame of video data including a plurality of color fields;

loading a first portion of a first color field of a frame of said video data into a display after said first portion of said first color field is loaded into said data buffer and before an entirety of said frame is loaded into said data buffer;

illuminating said display with a first colored light corresponding to said first color field;

loading a first portion of a second color field of said frame of said video data into said display after said first portion of said second color field is loaded into said data buffer and before said entirety of said frame is loaded into said data buffer;

illuminating said display with a second colored light corresponding to said second color field;

loading a first portion of a third color field of said frame of said video data into said display after said first portion of said third color field is loaded into said data buffer;

illuminating said display with a third colored light corresponding to said third color field;

loading a first portion of said first color field of a subsequent frame of video data and a remaining portion of said first color field of said frame of video data into said display after said first portion of said first color field of said subsequent frame of video data is loaded into said data buffer and before an entirety of said subsequent frame is loaded into said data buffer;

illuminating said display with said first colored light;

loading a first portion of said second color field of said subsequent frame of video data and a remaining portion of said second color field of said frame of video data into said display after said first portion of said second color field of said subsequent frame of video data is loaded into said data buffer and before said entirety of said subsequent frame is loaded into said data buffer;

illuminating said display with said second colored light;

loading a first portion of a third color field of said subsequent frame of video data and any remaining portion of said third color field of said frame of video data into said display after said first portion of said third color field of said subsequent frame of video data is loaded into said data buffer; and illuminating said display with said third colored light.

* * * * *